US005964630A

United States Patent [19]

Slusarczuk et al.

[11] Patent Number: 5,964,630

[45] Date of Patent: Oct. 12, 1999

[54] METHOD OF INCREASING RESISTANCE OF FLAT-PANEL DEVICE TO BENDING, AND ASSOCIATED GETTER-CONTAINING FLAT-PANEL DEVICE

[75] Inventors: Marko M. G. Slusarczuk, Portola Valley; Duane A. Haven, Cupertino; Christopher J. Curtin, Los Altos Hills; Theodore S. Fahlen, San Jose, all of Calif.

[73] Assignee: Candescent Technologies Corporation, San Jose, Calif.

[21] Appl. No.: 08/777,914

[22] Filed: Dec. 23, 1996

[51] Int. Cl.[6] ..... H01J 9/39

[52] U.S. Cl. ..... 445/25; 445/41; 445/40; 445/42; 313/554

[58] Field of Search ..... 445/24, 25, 41, 445/40, 42; 313/554

[56] References Cited

U.S. PATENT DOCUMENTS

| | | | |
|---|---|---|---|
| 4,021,219 | 5/1977 | Stockdale et al. | 65/43 |
| 4,346,951 | 8/1982 | Caras et al. | 445/25 |
| 4,563,617 | 1/1986 | Davidson | 315/312 |
| 4,618,801 | 10/1986 | Kakino | 313/495 |
| 5,083,058 | 1/1992 | Nonomura et al. | 313/482 |
| 5,160,871 | 11/1992 | Tomii et al. | 315/366 |
| 5,198,723 | 3/1993 | Parker | 313/634 |
| 5,223,766 | 6/1993 | Nakayama et al. | 313/495 |
| 5,424,605 | 6/1995 | Lovoi | 313/422 |
| 5,440,201 | 8/1995 | Martin et al. | 313/582 |
| 5,564,958 | 10/1996 | Itoh et al. | 445/6 |
| 5,589,731 | 12/1996 | Fahlen et al. | 313/495 |
| 5,798,609 | 8/1998 | Sol | 313/495 |

FOREIGN PATENT DOCUMENTS 0 050 294 4/1982 European Pat. Off. .

0 464 938 A1 1/1992 European Pat. Off. .

OTHER PUBLICATIONS

Branst et al, "The Challenge of Flat Panel Display Sealing," *Semiconductor Int'l*, Jan. 1996, pp. 109–112.

Busta, "Evaluation of Different Field–Emitter Structures and Materials for Their Suitability in Large–Area Displays Using Existing CRT Phosphors", *SID 94 Digest*, 1994, pp. 47–50.

Curtin, "The Field Emission Display: A New Flat Panel Technology", *Conf. Record 1991 Int'l Display Res. Conf.*, Oct. 15–17, 1991, pp. 12–15.

Tannas, *Flat–Panel Displays and CRTs* (Van Nostrand Reinhold), Section 7.9, 1985, pp. 217–221.

*Primary Examiner*—Kenneth J. Ramsey

*Attorney, Agent, or Firm*—Skjerven, Morrill, MacPherson, Franklin & Friel LLP; Ronald J. Meetin

[57] ABSTRACT

A flat-panel device is fabricated by a process in which a pair of plate structures (40 and 42) are sealed along their interior surfaces (40A and 42B) to opposite edges (44A and 44B) of an outer wall (44) to form a compartment. Subsequently, exterior support structure (64) is attached to the exterior surface of one of the plate structures (40) to significantly increase resistance of the compartment to bending. Exterior support structure (66) is normally likewise attached to the exterior surface of the other plate structure (42) after the sealing operation. The compartment is then typically pumped down to a high vacuum through a suitable pump-out port (46) and closed. By providing the exterior support structure at such a relatively late stage in the fabrication process, the need for using spacers to support the device against external forces is eliminated or substantially reduced while simultaneously avoiding severe fabrication difficulties that arise in attaching the exterior support structure before the sealing operation.

69 Claims, 14 Drawing Sheets

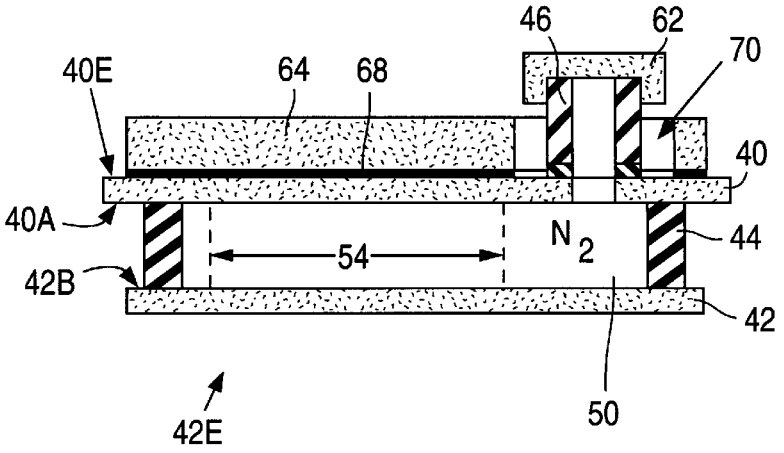
Fig. 2f1
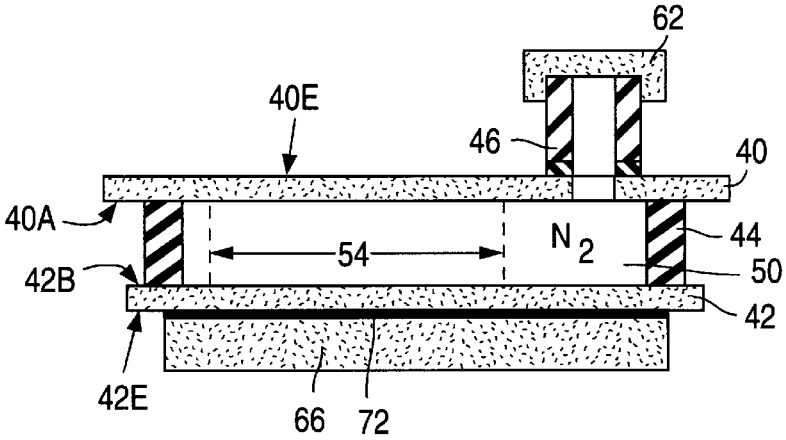
Fig. 2f2
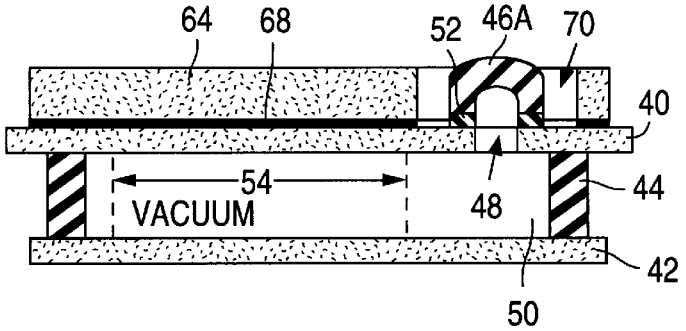
Fig. 2h1
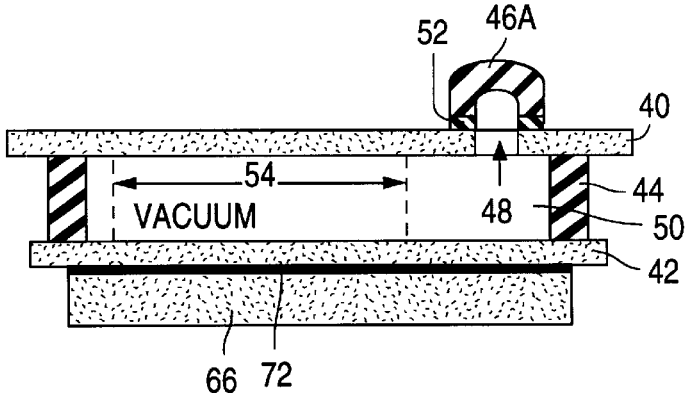
Fig. 2h2

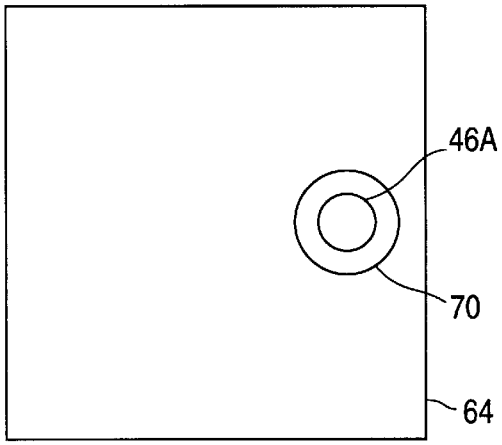
Fig. 3.1
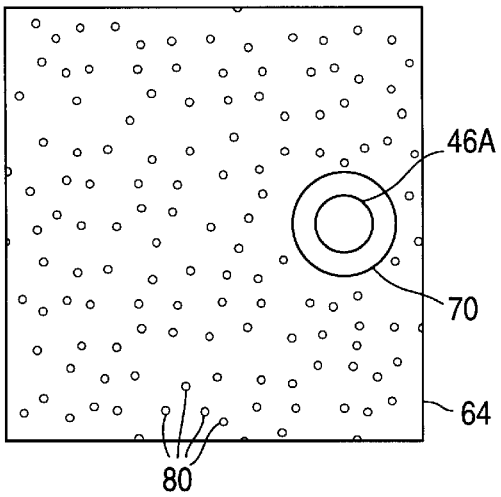
Fig. 3.2
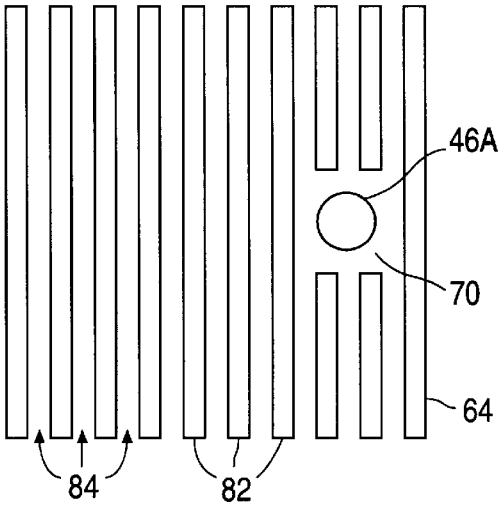
Fig. 3.3
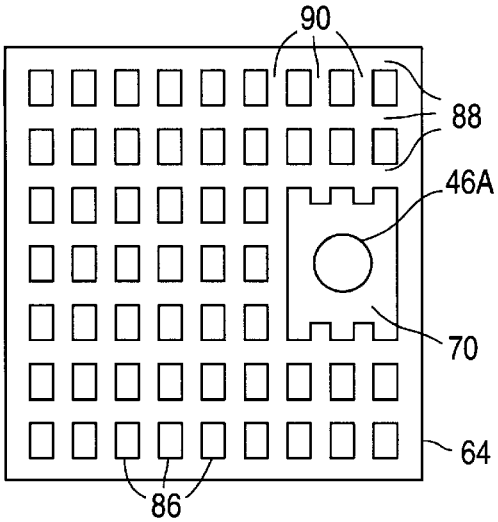
Fig. 3.4
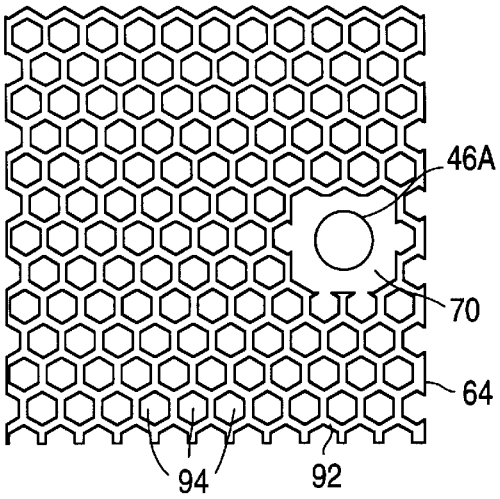
Fig. 3.5
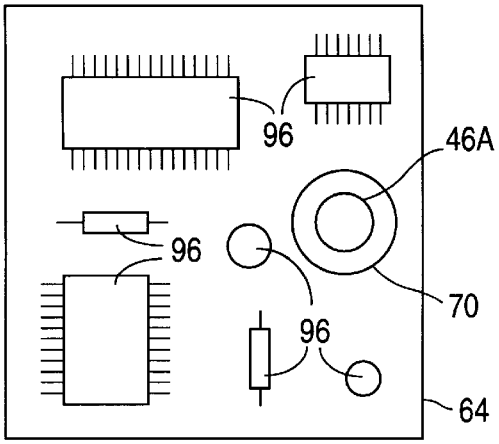
Fig. 3.6

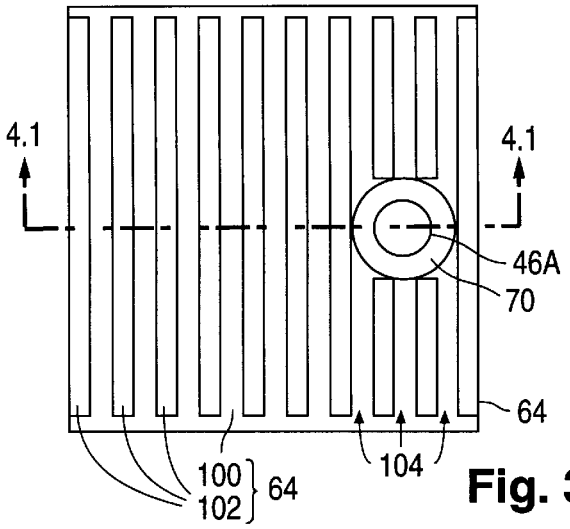
Fig. 3.7
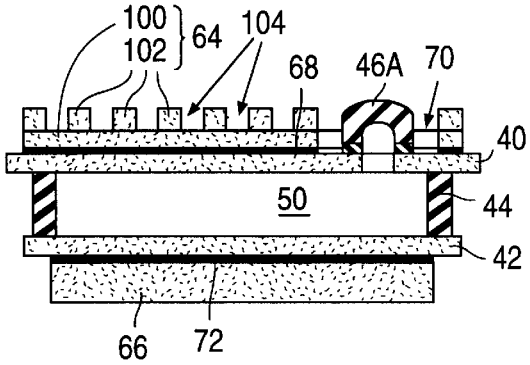
Fig. 4.1
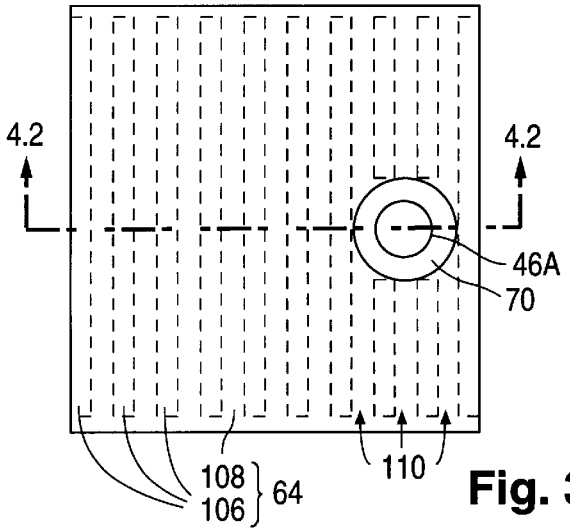
Fig. 3.8
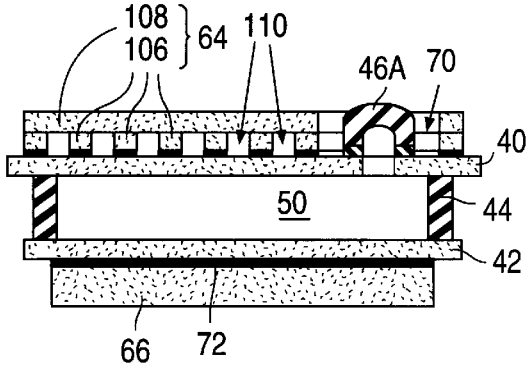
Fig. 4.2
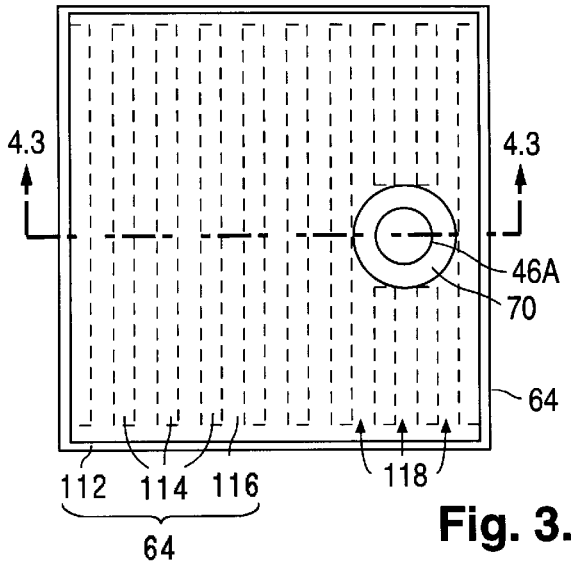
Fig. 3.9
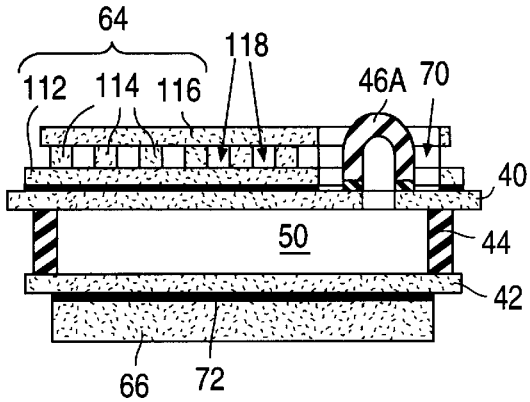
Fig. 4.3

Fig. 5.1
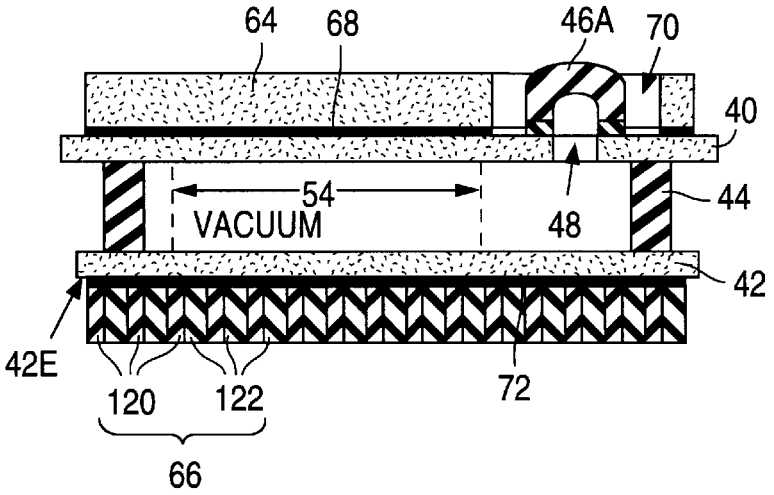
Fig. 5.2
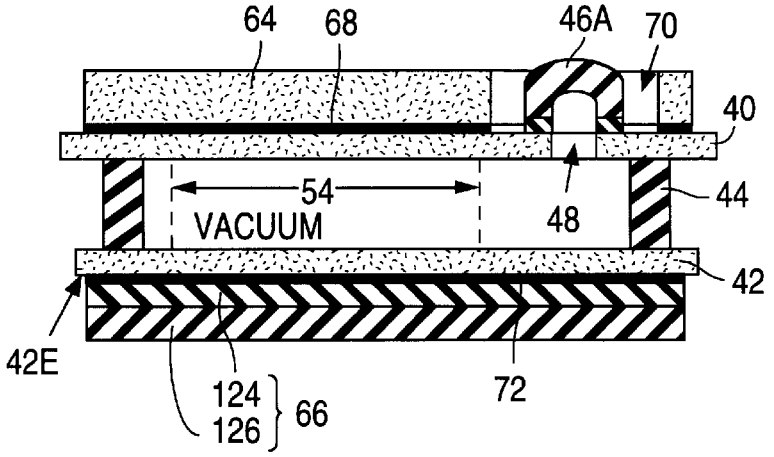
Fig. 5.3
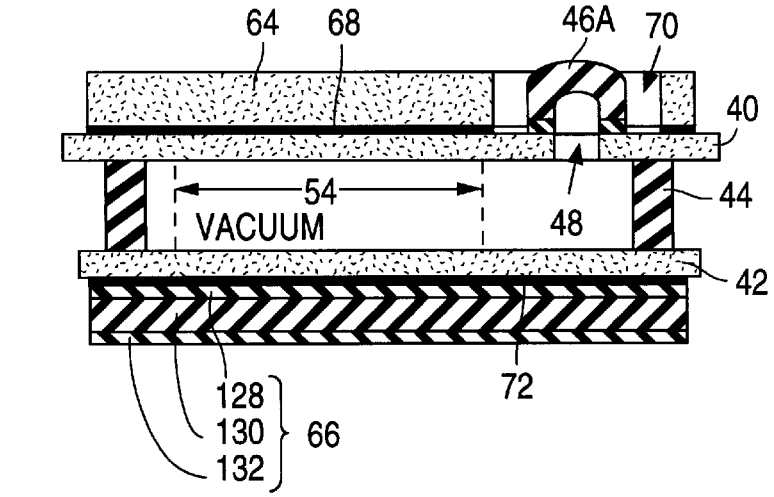

Fig. 6
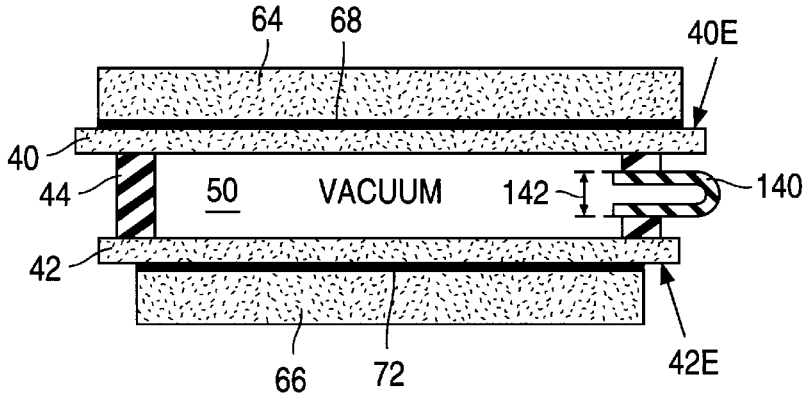
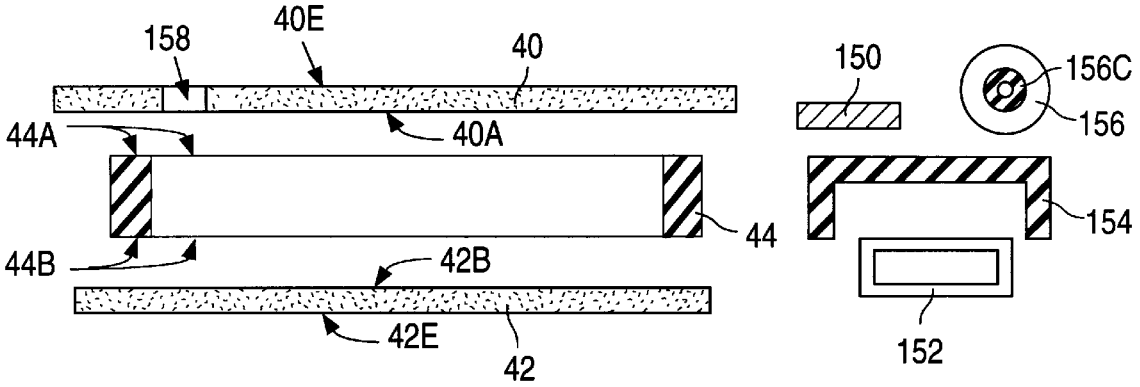
Fig. 7a
Fig. 7b
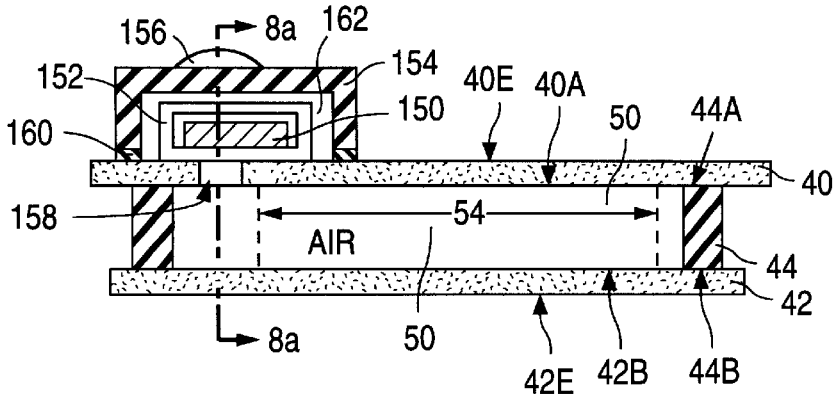

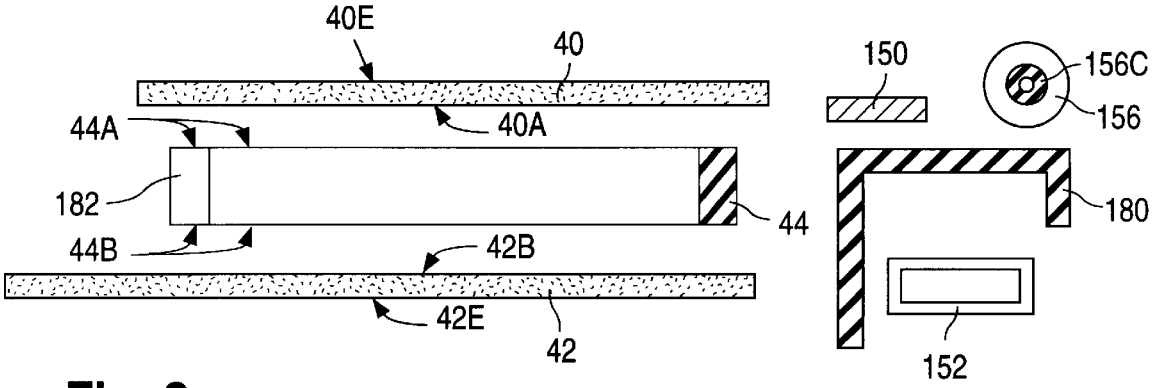
Fig. 9a
Fig. 9b
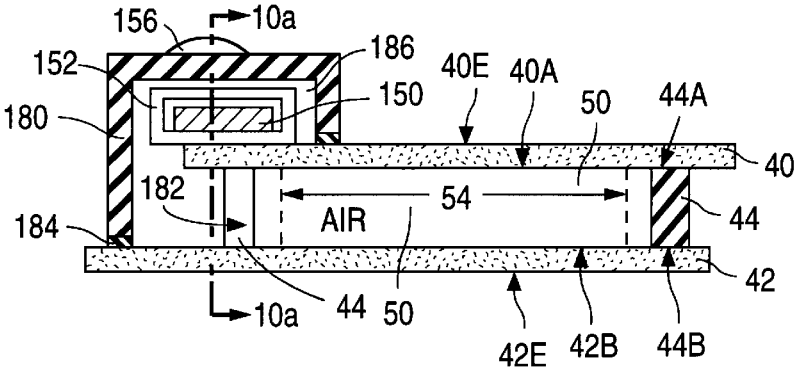
Fig. 9c
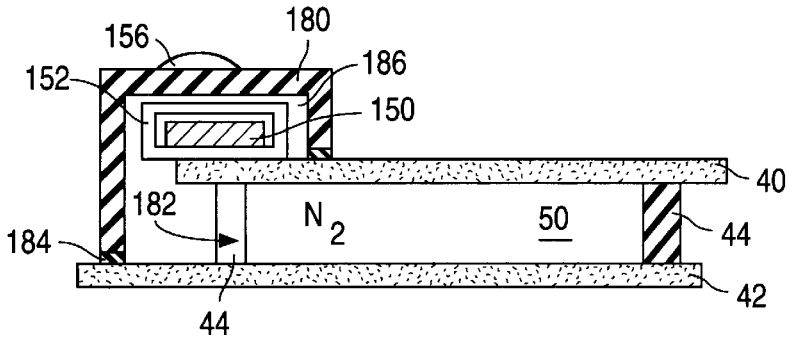

METHOD OF INCREASING RESISTANCE OF FLAT-PANEL DEVICE TO BENDING, AND ASSOCIATED GETTER-CONTAINING FLAT-PANEL DEVICE

FIELD OF USE

This invention relates to flat-panel devices and, especially, to methods for manufacturing flat-panel devices such as flat-panel displays of the cathode-ray tube ("CRT") type.

BACKGROUND

A flat-panel device contains a pair of generally flat plates connected together through an intermediate mechanism to form a relatively thin structure. When used for displaying information, a flat-panel device is typically referred to as a flat-panel display. The two plates are commonly termed the faceplate (or frontplate) and the baseplate (or backplate). The faceplate, which provides the viewing area for the display, is part of a faceplate structure containing one or more layers formed over the faceplate. The baseplate is similarly part of a baseplate structure containing one or more layers formed over the baseplate. The two plate structures are sealed together, typically through an outer wall.

A flat-panel display utilizes various mechanisms such as cathode rays (electrons), plasmas, and liquid crystals to display information on the faceplate. In a flat-panel CRT display, electron-emissive elements are typically provided over the interior surface of the baseplate. Upon being appropriately excited, the electron-emissive elements emit electrons that strike phosphors situated over the interior surface of the faceplate formed with transparent material such as glass. The phosphors then emit light visible on the exterior surface of the faceplate. By appropriately controlling the electron flow, a suitable image is displayed on the faceplate.

For proper display operation, the electron emission needs to occur in a highly evacuated environment, typically a pressure of $10^{-7}$ torr or less for a display of the field-emission type. The two plate structures in a flat-panel CRT display are quite thin. With the enclosure formed by the plate structures and outer wall being at a high vacuum, a pressure differential in the vicinity of 1 atm. is typically present across each plate structure.

Various techniques can be employed to prevent external forces, such as the outside-to-inside pressure differential, from collapsing the display. One conventional technique is to place spacers at suitable locations between the two plate structures. Besides enabling the display to resist external forces, the spacers maintain a fixed spacing between the plate structures.

Unfortunately, special efforts have to be taken in designing a flat-panel display to avoid having the spacers be visible on the viewing area of the faceplate. In addition, the spacers must be inserted carefully between the two plate structures. Usage of spacers thus increases the display manufacturing cost.

Another disadvantage of spacers is that they provide current leakage paths between the two plate structures, leading to increased power consumption. Also, the brightness of a flat-panel CRT display varies directly with the voltage at which the display is operated. That is, the display brightness increases as the operating voltage is increased. Spacers provide voltage breakdown paths that limit the operating voltage, thereby detrimentally affecting the display brightness. For these reasons, it is desirable to eliminate the spacers or, at the minimum, reduce the number needed for a display of given size.

FIGS. 1*a*–1*d* (collectively "FIG. 1") illustrate how a field-emission flat-panel CRT display, commonly referred to as a field-emission display ("FED"), is conventionally assembled. As shown in FIG. 1*a*, the components of the FED include baseplate structure 20, faceplate structure 22, outer wall 24, and multiple spacer walls 26. The FED also has pump-out tube 28 for evacuating the display. Opening 30 extends through baseplate structure 20 at the attachment location for pump-out tube 28.

Display components 20–28 are assembled as depicted in FIG. 1*b*. Spacers 26 are placed at various locations between plate structures 20 and 22. Pump-out tube 28 is connected to baseplate structure 20 by way of frit (sealing glass) 32 above opening 30. When outer wall 24 consists of frit, wall 24 is sealed directly to plate structures 20 and 22. The sealing of plate structures 20 and 22 is typically performed at a temperature of 450° C. to greater than 600° C.

When the sealing operation is complete, the enclosure formed with plate structures 20 and 22 and outer wall 24 is pumped down to a high vacuum using a vacuum pump 34P of a vacuum pumping system 34 having a tube 34T connected to pump-out tube 28. See FIG. 1*c*. Subsequent to pump-down, tube 28 is closed with a heating element to seal the display. FIG. 1d shows the sealed FED in which item 28A is the closed remainder of tube 28. Spacer walls 26 are the spacers that it is desirable to reduce in number or eliminate. In so doing, it is desirable that compatibility with a pump-out tube, such as tube 28/28A, be present.

GENERAL DISCLOSURE OF THE INVENTION

The present invention furnishes a process for manufacturing a flat-panel device, especially a flat-panel CRT display such as a field-emission display, of enhanced strength so that the device can successfully withstand external forces, such as atmospheric pressure, while eliminating or substantially reducing the need for using spacers to withstand the forces. The present fabrication process does not introduce any current leakage paths into the flat-panel device aside from those that may arise due to the use of a comparatively small number of spacers in the device. Power consumption is thus reduced compared to a prior art flat-panel device that utilizes a comparatively large number of spacers.

By not using spacers to withstand external forces or by substantially reducing the comparative number of spacers so employed, the occurrence of spacer-produced voltage breakdown paths is avoided or substantially reduced in a flat-panel display fabricated according to the invention. This permits the display to be operated at higher voltages. The display brightness can thereby be increased. Consequently, the present fabrication process overcomes the disadvantages of conventional flat-panel display manufacturing processes such as that illustrated in FIG. 1. The manufacturing process of the invention is also compatible with the use of a pump-out tube for evacuating the display.

More particularly, in accordance with the invention, a method for manufacturing a flat-panel device is initiated by hermetically sealing (a) a surface of a first plate structure to one edge of an outer wall and (b) a surface of a second plate structure to the opposite edge of the outer wall to form a device compartment from the two plate structures and outer wall. The two surfaces of the plate structures thus constitute their interior surfaces.

At this point, the pressure in the compartment is normally pumped down to a low value through a port mechanism. The pressure outside the compartment is preferably adjusted to a similar low value so that no significant pressure differential exists across either plate structure. Contaminant gases can subsequently be baked out of the plate structures and outer wall at a relatively high temperature, normally while the pumping is ongoing.

A selected gas is then typically introduced into the compartment through the port mechanism. The compartment is usually brought up to approximately room pressure with the selected gas while the pressure outside the compartment is likewise adjusted to approximately room pressure. Further steps can be performed on the device at room pressure, externally and internally, without collapsing the compartment due to a significant pressure differential across either plate structure.

The selected gas typically consists primarily of nitrogen or inert gas, neither of which normally reacts with any of the device components during high-temperature operations. Accordingly, the device is not significantly damaged during later steps due to the presence of the selected gas in the compartment. Importantly, arranging the device fabrication steps in this manner avoids exposing device elements along the inside of the compartment to oxygen or other reactive air components that could damage those elements.

First support structure is subsequently attached to the exterior surface of the first plate structure to increase the resistance of the flat-panel device to bending. By making the first support structure suitably thick, the device can withstand strong external forces, provided that the second plate structure is suitably thick or/and second support structure is attached to the exterior surface of the second plate structure. A relatively constant spacing can thus be readily maintained between the plate structures. The necessity for using spacers to withstand external forces is eliminated or substantially reduced. The first support structure and, when present, the second support structure improve the capability of the flat-panel device to withstand shock due to impact and rough handling.

The first support structure is preferably bonded to the first plate structure largely wherever they substantially adjoin. The same applies to the second support structure relative to the second plate structure. As with the first support structure, the second support structure is attached to the flat-panel device after hermetic sealing of the two plate structures to the outer wall is complete. In contrast to conventional spacers which constitute interior support structure, both the first and second support structures constitute exterior support structure.

As used here in describing how exterior support structure is incorporated into a flat panel device according to the invention, the word "attach" is intended to cover both the situation in which the exterior support structure is connected to the flat-panel device through separate bonding material and the situation in which the exterior support structure is connected directly to the device—i.e., without using separate bonding material. Attachment of exterior support structure to a flat-panel device by direct connection can, for example, occur by bringing liquid material of otherwise rigid exterior support structure into contact with the flat-panel device and then causing or allowing the liquid material to become rigid. Alternatively, exterior support structure can be deposited on the flat-panel device in liquid form and then caused or allowed to become rigid.

By attaching the exterior support structure to the flat-panel device after the two plate structures are hermetically sealed to the outer wall and the bake-out step is complete, the exterior support structure and, when present, the bonding material are not subjected to the high bake-out temperature. Nor is the exterior support structure or bonding material subjected to high temperatures that occur during the hermetic sealing of the two plate structures to the outer wall or during fabrication of the plate structures. Consequently, the exterior support structure and bonding material can consist of materials that are unable to withstand high temperatures of the sealing, bake, and plate-structure fabrication steps. This substantially increases the range of materials that can be used for the exterior support structure and bonding material.

Also, the exterior support structure is attached to the flat-panel device at a sufficiently late stage in the overall device fabrication process that the presence of the exterior support structure does not have any significant detrimental effect on the fabrication of either plate structure. The steps in the present manufacturing process are thus performed in a sequence that enables the resulting flat-panel device to be strong. Furthermore, the manufacturing steps can be performed economically.

After attaching the exterior support structure to the flat-panel device, the device compartment is normally pumped down to a low pressure through the port mechanism. Another bake step can then be performed to cause additional outgassing from the two plate structures and outer wall. This bake step is done at a temperature sufficiently low that no significant damage occurs to the exterior support structure or, when present, the bonding material. In particular, the maximum temperature reached during this bake step is normally less than the maximum temperature reached during the earlier bake step. Closure of the port mechanism completes the device sealing.

The exterior support structure can be implemented in various ways. For example, the exterior support structure can be solid or porous. The material used in the exterior support structure can be glass, plastic, polymeric material such as polycarbonate, another type of dielectric such as ceramic, or/and metal. The exterior support structure can be configured as multiple bars or rings, a combination of bars and one or more plates, a honeycomb, or a printed-circuit board that contains control circuitry for controlling the flat-panel device. The exterior support structure is typically sized so that the port mechanism does not extend significantly further away from the first plate structure than the exterior support structure. Disadvantages, such as increased handing care, which result from a pump-out tube that protrudes far from the bulk of a flat-panel device are substantially avoided in the invention.

In one implementation of a flat-panel device that can be fabricated according to the invention, multiple getters are integrated into the exterior support structure. Specifically, the exterior support structure includes a support member that contacts the first plate structure outside the main compartment formed with the two plate structures and outer wall. The support member has a plurality of cavities that form corresponding auxiliary compartments with the first plate structure. Each auxiliary compartment is connected pressure-wise to the main compartment or to at least one other auxiliary compartment. Each of the getters is situated in a different one of the auxiliary compartments.

While the need for utilizing spacers in the conventional FED manufacturing process of FIG. 1 could conceivably be eliminated or substantially reduced by making both plate structures much thicker before sealing them together through an outer wall to form an FED, doing so would result in a number of severe problems. For example, high temperatures inevitably present during fabrication of the plate structures at such increased thicknesses would increase the stress level in at least one of the plate structures. The likelihood of cracking the FED would thus be increased.

Increasing the thicknesses of both plate structures before they are sealed together would increase the FED weight at an early point in the manufacturing process. In turn, this would necessitate greater handling care and much stronger fabrication equipment. Also, equipment currently used in fabricating FED plate structures is generally limited to thin plate structures where the thickness is typically in the vicinity of 1 mm. New fabrication equipment would likely have to be developed to handle thick plate structures, a major economic disadvantage. The increased FED weight at an early point in the manufacturing process would decrease the FED throughput considerably due to attendant longer heating and cooling times in high temperature steps. The manufacturing process of the invention avoids these problems.

The invention provides the flexibility to attach exterior support structure to the outside of one or both plate structures at a late stage in the fabrication of a flat-panel device. When the exterior support structure is attached to only one of the plate structures, the other plate structure normally must be thick and strong enough to withstand external forces, such as air pressure, without the aid of spacers between the plate structures or with the aid of only a comparatively small number of spacers. Although suitably thick exterior support structure is typically attached to both plate structures in the invention, there are likely to be situations in which the severity of the above-mentioned disadvantages in using thick plate structures are substantially lessened when only one of the plate structures is thick. The flexibility to attach exterior support structure to the outside of only one of the plate structures, provided that the other plate structure is suitably thick, is an important feature of the invention.

In short, the present method for manufacturing a flat-panel device is highly advantageous. The resistance of the device to bending is significantly increased while substantially reducing, or eliminating, the need for awkward spacers. The steps in the present manufacturing process are arranged so as to largely avoid subjecting the components of the flat-panel device to conditions that could lead to significant device degradation. The ability of the device to withstand shock is much enhanced. The invention thus provides a significant advance over the prior art.

BRIEF DESCRIPTION OF THE DRAWINGS

FIGS. 2*f*1 and 2*f*2 are cross-sectional views representing alternative versions of a step that precedes the step of FIG. 2*f*. Each of FIGS. 2*f*1 and 2*f*2 also represents an alternative to the step of FIG. 2*f* in accordance with the invention.

Figure 1A:
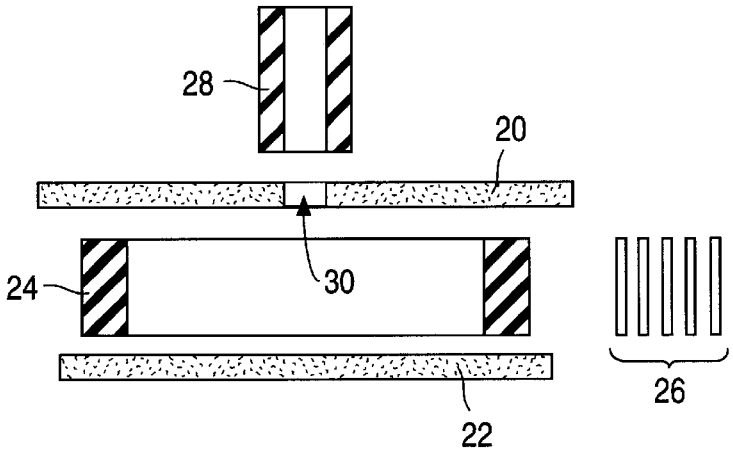
Fig. 1a PRIOR ART
FIGS. 1*a*–1*d* are cross-sectional side views representing steps in a conventional process for manufacturing a flat-panel display.
Figure 1B:
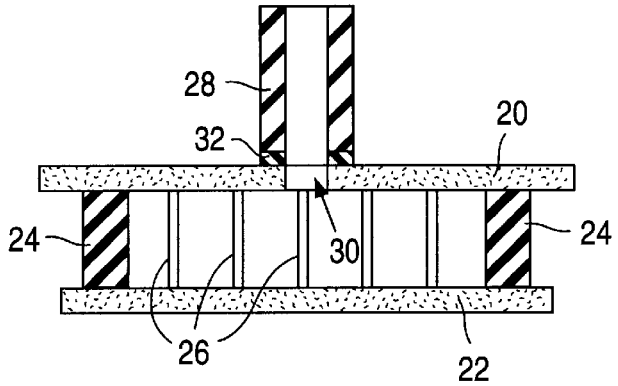
Fig. 1b PRIOR ART
Figure 1C:
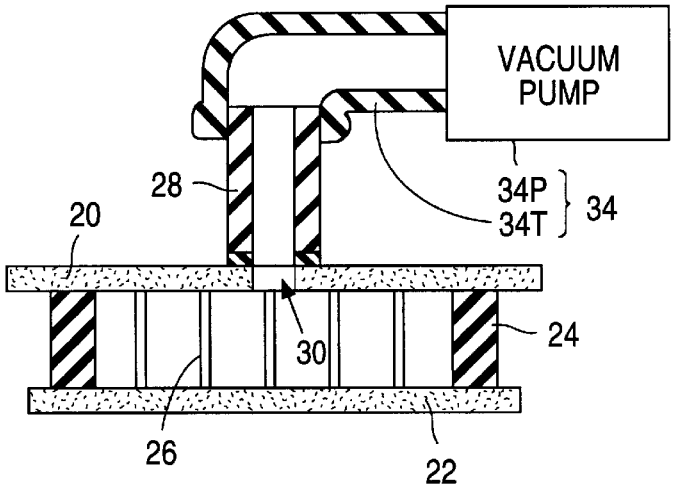
Fig. 1c PRIOR ART
Figure 1D:
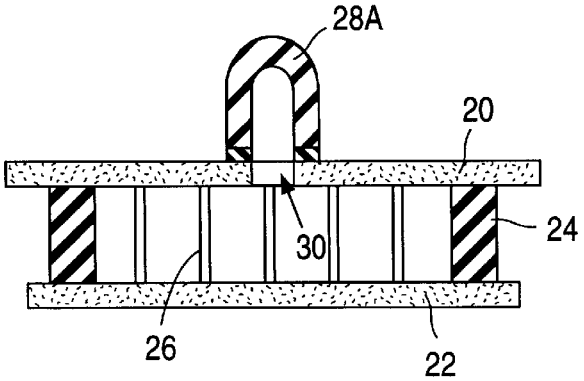
Fig. 1d PRIOR ART
Figure 2A:
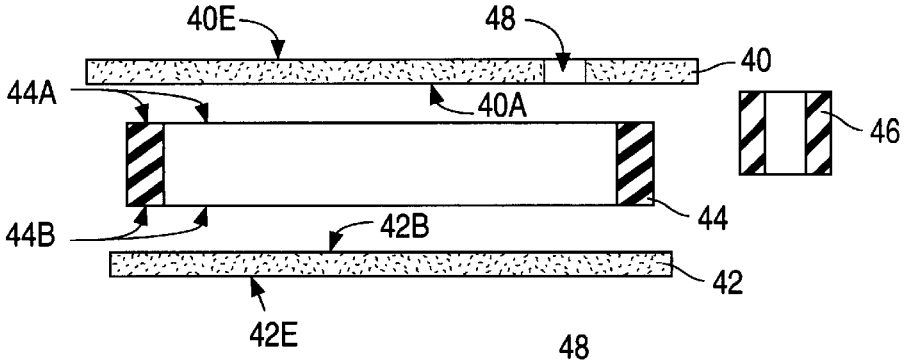
FIGS. 2*a*–2*h* are cross-sectional side views representing steps in a process for manufacturing a flat-panel display in accordance with the invention.
Figure 2B:
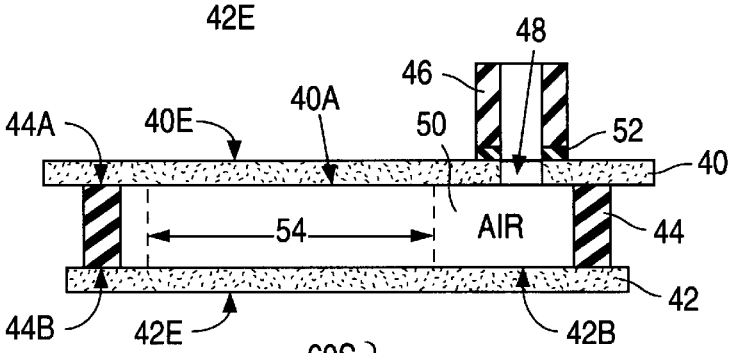
Figure 2C:
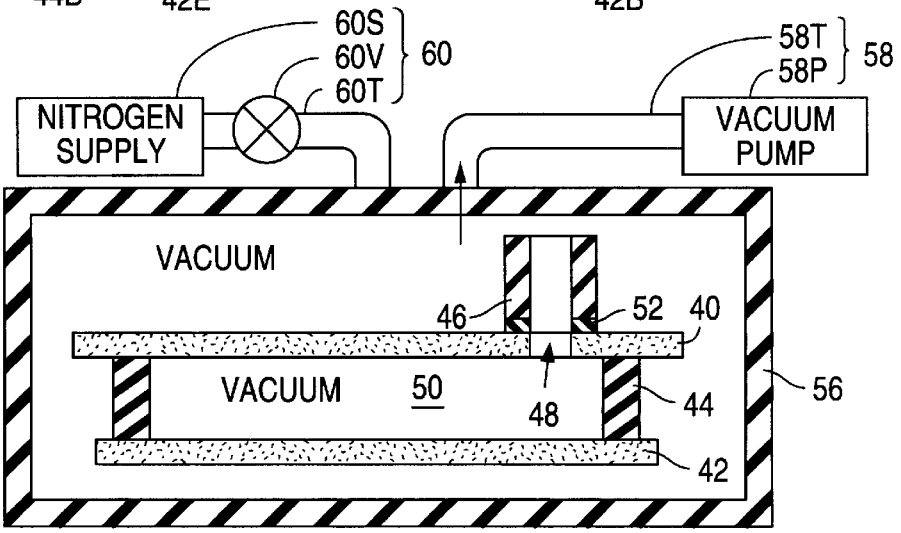
Figure 2D:
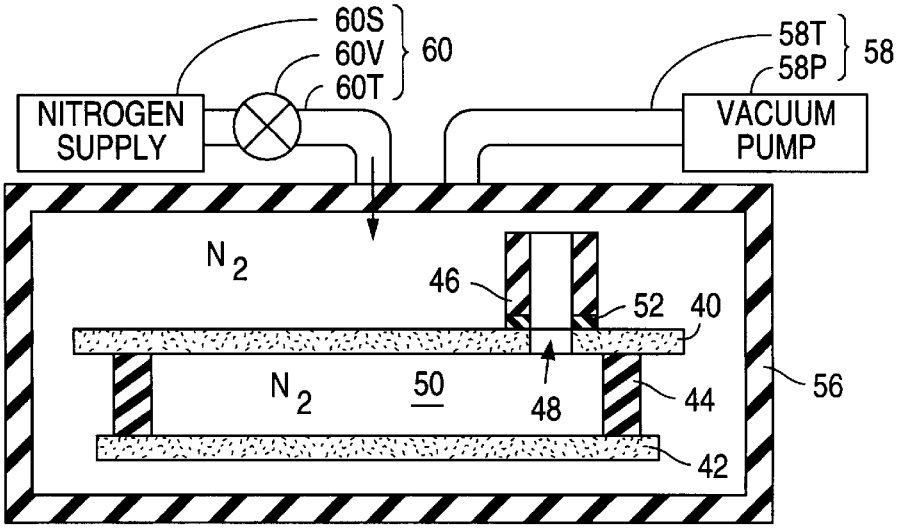
Figure 2E:
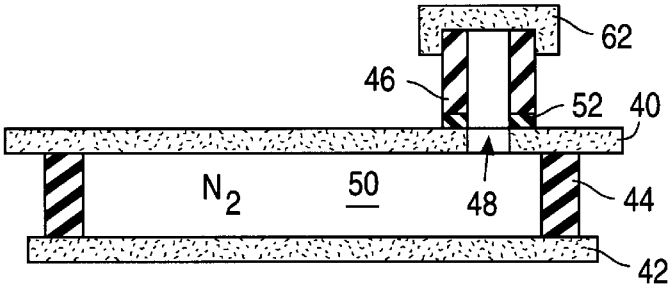
Figure 2F:
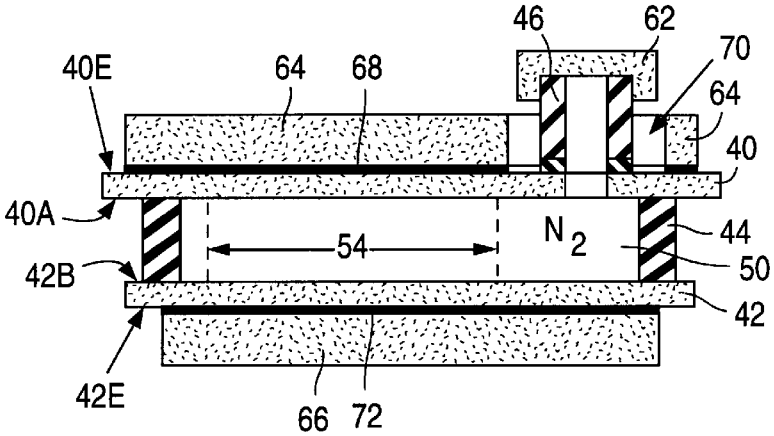
Figure 2G:
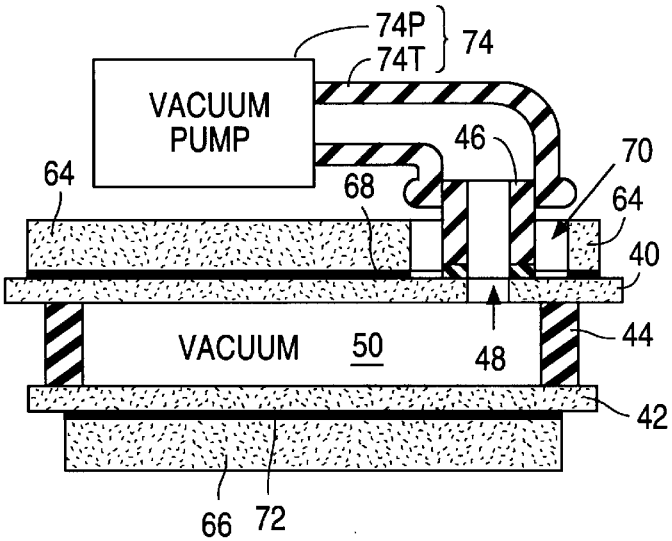
Figure 2H:
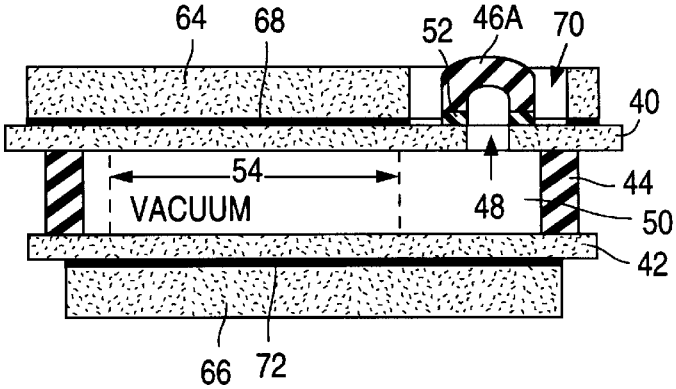

Each of FIGS. 2*h*1 and 2*h*2 is a cross-sectional side view representing an alternative to the step of FIG. 2*h* in accordance with the invention.

FIGS. 3.1–3.9 are plan views of embodiments of the baseplate support structure in the flat-panel display of FIG. 2*h* in accordance with the invention.

FIGS. 4.1–4.3 are cross-sectional side views of the flat-panel display of FIG. 2*h* as respectively embodied with the baseplate support structures of FIGS. 3.7–3.9. The cross section of FIG. 4.1 is taken through plane 4.1—4.1 in FIG. 3.7. The cross section of FIG. 4.2 is taken through plane 4.2—4.2 in FIG. 3.8. The cross section of FIG. 4.3 is taken through plane 4.3—4.3 in FIG. 3.9.

FIGS. 5.1–5.3 are cross-sectional views of the flat-panel device of FIG. 2*h* as embodied respectively with three different faceplate support structures in accordance with the invention.

FIG. 6 is a cross-sectional side view of a side-port flat-panel display provided with exterior support structure in accordance with the invention.

FIGS. 7*a*–7*e* are cross-sectional side views representing steps in a further process for manufacturing a flat-panel display in accordance with the invention.

Figure 7C:
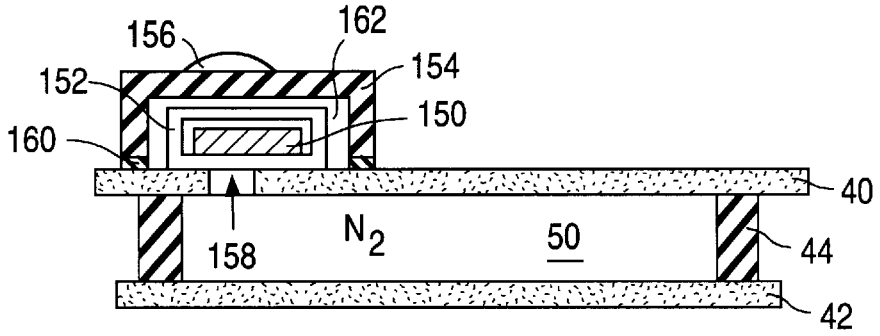
Figure 7D:
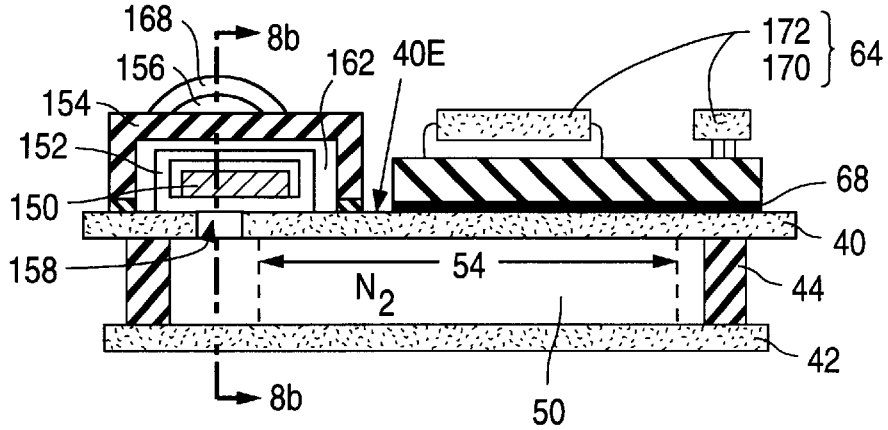
Figure 7E:
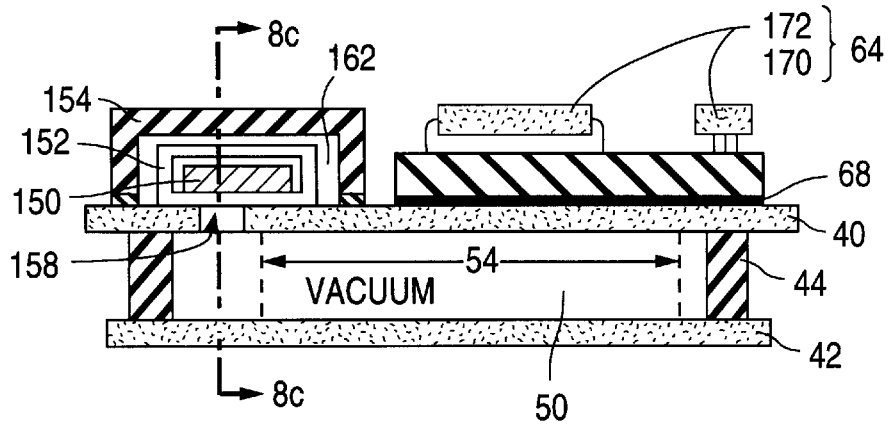
Figure 8A:
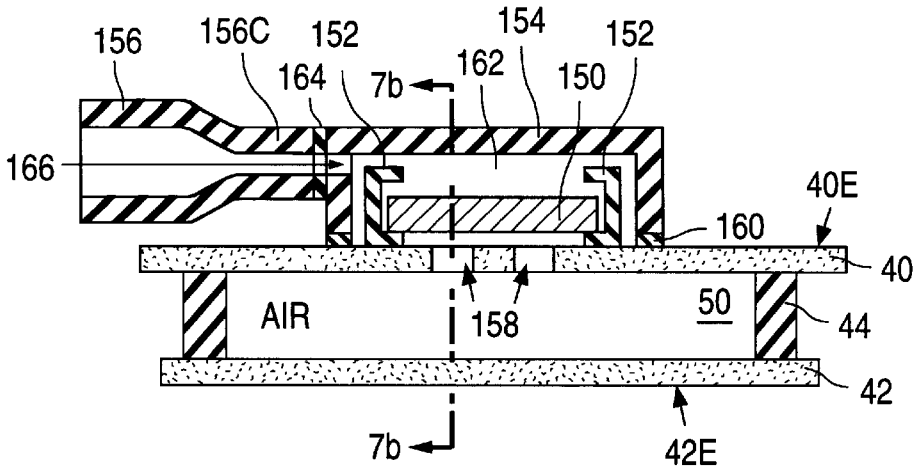
Figure 8B:
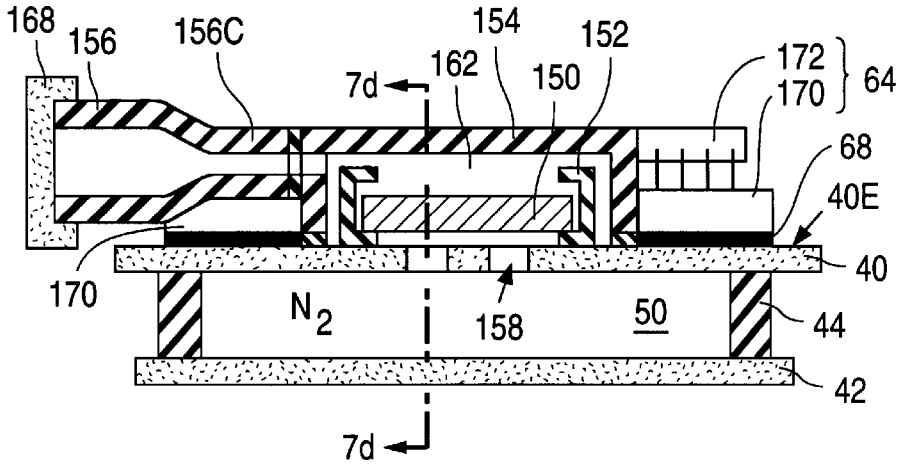
Figure 8C:
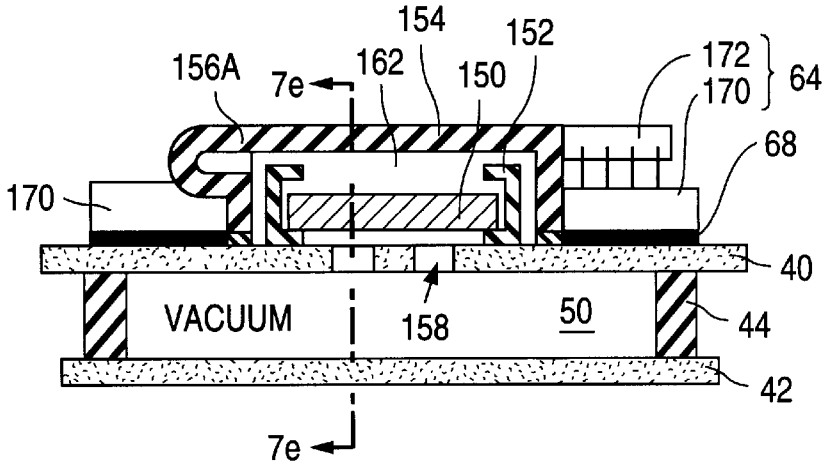

FIGS. 8*a*–8*c* cross-sectional side views respectively corresponding to the views of FIGS. 7*b*, 7*d*, and 7*e*. The cross sections of FIGS. 8*a*–8*c* are respectively taken through planes 8*a*—8*a*, 8*b*—8*b*, and 8*c*—8*c* in FIGS. 7*b*, 7*d*, and 7*e*. The cross sections of FIGS. 7*b*, 7*d*, and 7*e* are respectively taken through planes 7*b*—7*b*, 7*d*—7*d*, and 7*e*—7*e* in FIGS. 8*a*–8*c*.

FIGS. 9*a*–9*e* are cross-sectional side views representing yet another process for manufacturing a flat-panel display in accordance with the invention.

Figure 9D:
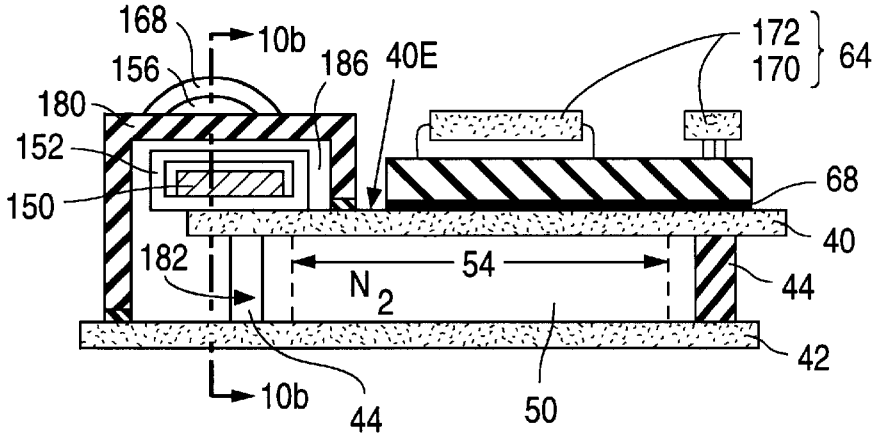
Figure 9E:
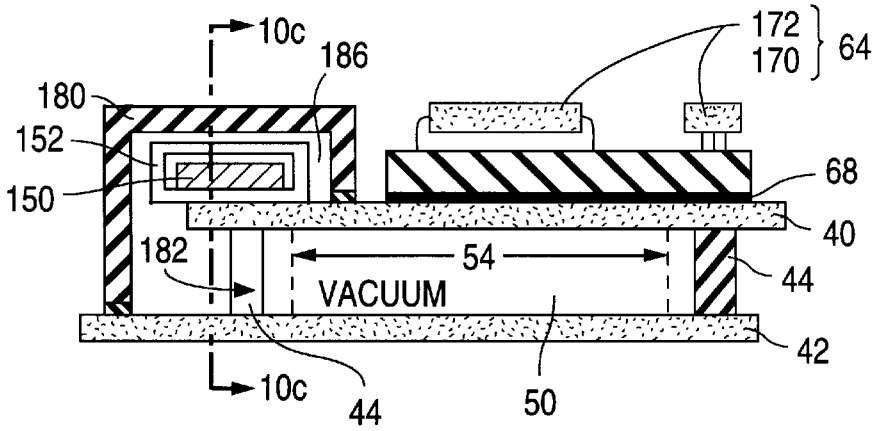
Figure 10A:
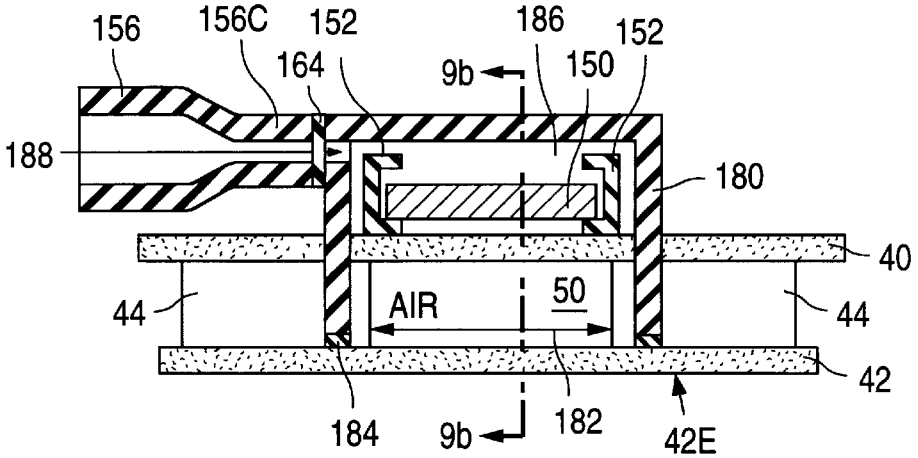
Figure 10B:
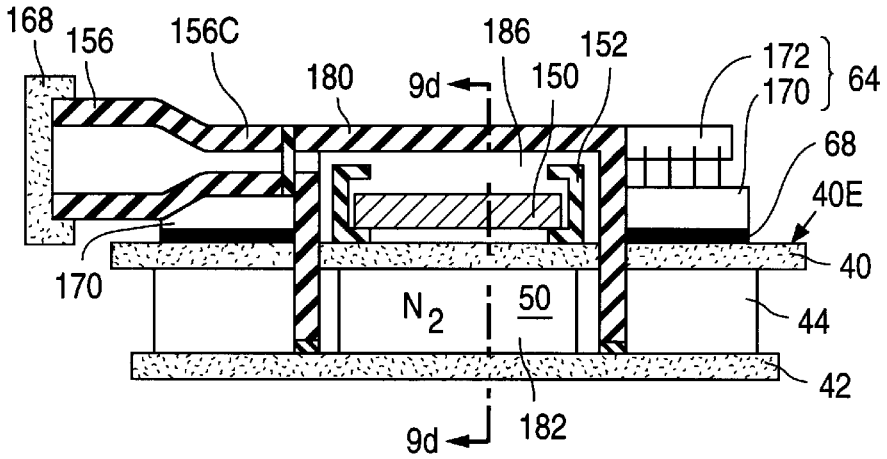
Figure 10C:
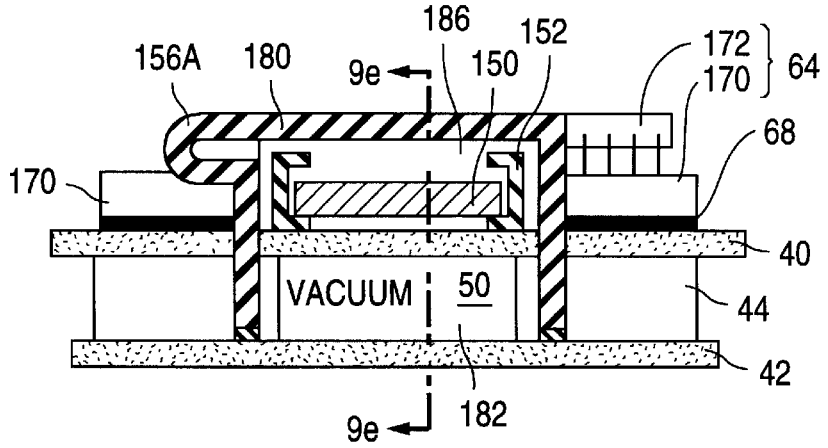

FIGS. 10*a*–10*c* are cross-sectional side views respectively corresponding to the views of FIGS. 9*b*, 9*d*, and 9*e*. The cross sections of FIGS. 10*a*–10*c* are respectively taken through planes 10*a*—10*a*, 10*b*—10*b*, and 10*c*—10*c* in FIGS. 9*b*, 9*d*, and 9*e*. The cross sections of FIGS. 9*b*, 9*d*, and 9*e* are respectively taken through planes 9*b*—9*b*, 9*d*—9*d*, and 9*e*—9*e* in FIGS. 10–10*c*.

Figure 11:
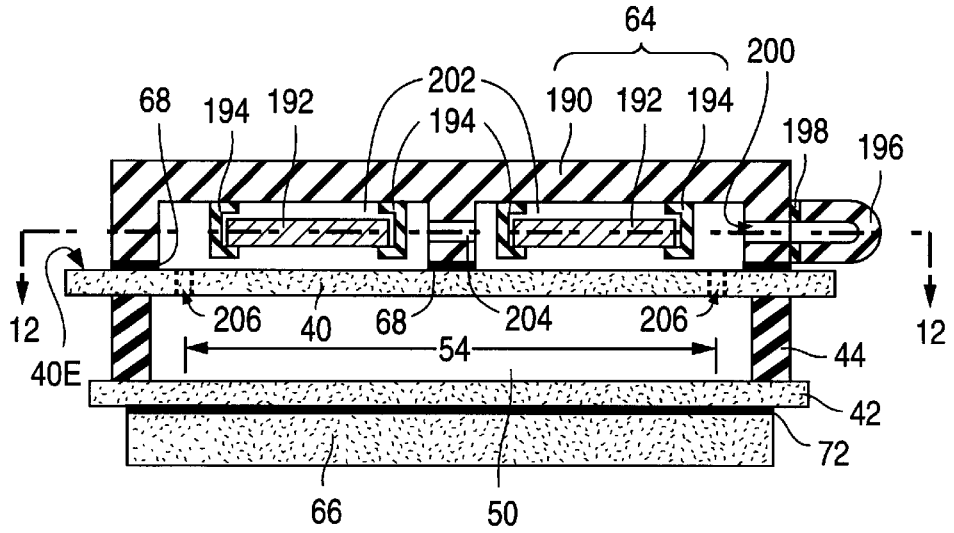

FIG. 11 is a cross-sectional side view of a flat-panel display manufactured in accordance with the invention so as to have multiple getter-containing auxiliary compartments integrated into the baseplate support structure.

Figure 12:
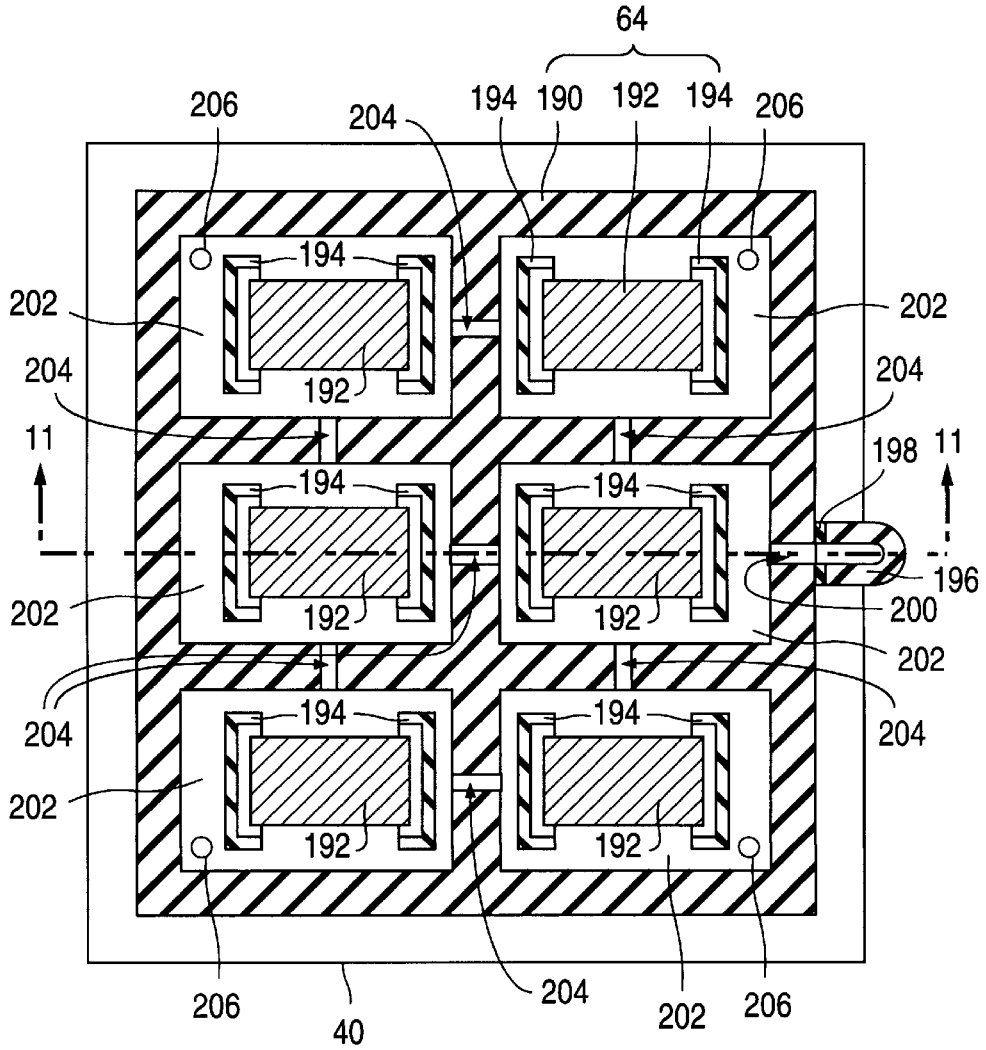

FIG. 12 is a cross-sectional plan view of the flat-panel display of FIG. 11. The cross section of FIG. 12 is taken through plane 12—12 in FIG. 11. The cross section of FIG. 11 is taken through plane 11—11 in FIG. 12.

Like reference symbols are employed in the drawings and in the description of the preferred embodiments to represent the same, or very similar, item or items.

DESCRIPTION OF THE PREFERRED EMBODIMENTS

FIGS. 2*a*–2*h* (collectively "FIG. 2") illustrate how a flat-panel display is manufactured according to the teachings of the invention so as enhance the resistance of the display to bending while eliminating, or substantially reducing, the need for using internal spacers to resist external forces applied to the display. Side views are generally shown in FIG. 2. FIGS. 2*f*1 and 2*f*2 depict different routes to go from the step of FIG. 2*e* to the step of FIG. 2*f*. Alternatively, each of FIGS. 2*f*1 and 2*f*2 illustrates a different way to modify the step of FIG. 2*f*. FIGS. 2*h*1 and 2*h*2 illustrate how the step of FIG. 2*h* is modified when the step of FIG. 2*f* is modified according to the respective steps of FIGS. 2*f*1 and 2*f*2.

As used herein, the "exterior" surface of a faceplate structure in a flat-panel display is the surface on which the display's image is provided. The opposite side of the faceplate structure is referred to as its "interior" surface even though part of the interior surface of the faceplate structure is normally outside the compartment formed by sealing the faceplate structure to a baseplate structure through an outer wall. Likewise, the surface of the baseplate structure situated opposite the interior surface of the faceplate structure is referred to as the "interior" surface of the baseplate structure even though part of the interior surface of the baseplate structure is normally outside the compartment formed with the two plate structures and the outer wall. The side of the baseplate structure opposite to its interior surface is referred to as the "exterior" surface of the baseplate structure.

With the foregoing in mind, the components of the flat-panel display assembled according to the process of FIG. 2 include a baseplate structure 40, a faceplate structure 42, an outer wall 44, and a pump-out tube 46. Baseplate structure 40 has an interior surface 40A and an exterior surface 40E. Faceplate structure 42 has an interior surface 42B and an exterior surface 42E. Outer wall 44 has a pair of opposing edges 44A and 44B which, as described below, are hermetically sealed to interior surfaces 40A and 42B of plate structures 40 and 42.

Each of plate structures 40 and 42 is generally rectangular in shape. The internal constituency of plate structures 40 and 42 is not shown in the drawings. However, baseplate structure 40 consists of a baseplate and one or more layers formed over the interior surface of the baseplate. Faceplate structure 42 consists of a transparent faceplate and one or more layers formed over the interior surface of the faceplate.

Each of plate structures 40 and 42 is quite thin. Baseplate structure 40 typically has a thickness of 0.5–5 mm, preferably close to 1 mm. The bulk of the baseplate structure thickness is provided by the baseplate itself whose thickness is typically 50 $\mu$m less than the baseplate structure thickness. Faceplate structure 42 likewise typically has a thickness of 0.5–5 mm, preferably close to 1 mm. The bulk of the faceplate structure thickness is similarly provided by the faceplate itself whose thickness is typically 50 Am less than the faceplate structure thickness.

Outer wall 44 is usually formed with four sub-walls arranged in a rectangular annulus. The four sub-walls may be connected together directly or through corner pieces. The height of outer wall 44 is 25 $\mu$m–10 mm, typically 0.5–2 mm. In accordance with the process utilized to assemble and hermetically seal the flat-panel display, the outer wall height substantially equals the largely uniform spacing that exists between plate structures 40 and 42 after assembly and sealing are completed.

Outer wall 44 typically consists of frit, at least along wall edges 44A and 44B. Materials such as glass and ceramic may be used in outer wall 44 away from edges 44A and 44B. In any case, the material of wall 44 along all of each of edges 44A and 44B normally melts at a temperature sufficiently low that neither of plate structures 40 and 42 is damaged when raised to that temperature.

Pump-out tube 46 is to be used in removing gas from, and introducing gas into, the inside of the otherwise sealed display through a pump-out opening 48 extending through baseplate structure 40. Tube 46 typically consists of glass.

The process of the invention eliminates, or substantially reduces, the need for placing spacers, such as spacer walls or/and spacer posts, between plate structures 40 and 42 in order to strengthen the flat-panel display and prevent it from collapsing due to external forces such as air pressure. Accordingly, the views of FIG. 2 do not illustrate any spacers that are to be placed between structures 40 and 42. Nonetheless, the display may be provided with a relatively small number of spacers, typically largely parallel spacer walls. If so, the number of spacer walls per unit dimension of baseplate structure 40 in the direction perpendicular to the spacer walls is quite small compared to the number of spacer walls placed between the plate structures in a conventional display of approximately the same diagonal length as the display fabricated according to the process of FIG. 2 but lacking exterior support structure provided according to the invention.

Similar comments apply to spacer posts which may be implemented as spheres or which, as viewed in the direction perpendicular to plate structure 40 or 42, may alternatively be in the shape of rectangles, circles, crosses, and the like. That is, the number of spacer posts inserted between plate structures 40 and 42 to strengthen the present flat-panel display is quite small compared to the number of spacer posts placed between the plate structures of a conventional flat-panel display of approximately the same diagonal length as the present display.

A flat-panel display assembled according to the process of FIG. 2 can be any one of a number of different types of reduced-pressure flat-panel displays such as vacuum CRT displays, vacuum fluorescent displays, and plasma displays. In a flat-panel CRT display that operates according to field-emission principles, baseplate structure 40 contains a two-dimensional array of picture elements ("pixels") of electron-emissive elements provided over the baseplate. The electron-emissive elements form a field-emission cathode.

In particular, baseplate structure 40 in a field-emission display (again, "FED") typically has a group of emitter row electrodes that extend across the baseplate in a row direction. An inter-electrode dielectric layer overlies the emitter electrodes and contacts the baseplate in the space between the emitter electrodes. At each pixel location in baseplate structure 40, a large number of openings extend through the inter-electrode dielectric layer down to a corresponding one of the emitter electrodes. Electron-emissive elements, typically in the shape of cones or filaments, are situated in each opening in the inter-electrode dielectric.

A patterned gate layer is situated on the inter-electrode dielectric. Each electron-emissive element is exposed through a corresponding opening in the gate layer. A group of column electrodes, either created from the patterned gate layer or from a separate column-electrode layer that contacts the gate layer, extend over the inter-electrode dielectric in a column direction perpendicular to the row direction. The emission of electrons from the pixel at the intersection of each row electrode and each column electrode is controlled by applying appropriate voltages to the row and column electrodes.

Faceplate structure 42 in the FED contains a two-dimensional array of phosphor pixels formed over the interior surface of the transparent faceplate. An anode, or collector electrode, is situated adjacent to the phosphors in structure 42. The anode may be situated over the phosphors, and thus is separated from the faceplate by the phosphors. In this case, the anode typically consists of a thin layer of electrically conductive light-reflective material, such as aluminum, through which the emitted electrons can readily pass to strike the phosphors. The light-reflective layer increases the display brightness by redirecting some of the rear-directed light back towards the faceplate. U.S. Pat. Nos. 5,424,605 and 5,477,105 describe examples of FEDs having faceplate structure 42 arranged in the preceding manner. Alternatively, the anode can be formed with a thin layer of electrically conductive transparent material, such as indium tin oxide, situated between the faceplate and the phosphors.

When the FED is arranged in either of the preceding ways, application of appropriate voltages to the row and column electrodes in baseplate structure 40 causes electrons to be extracted from the electron-emissive elements at selected pixels. The anode, to which a suitably high voltage is applied, draws the extracted electrons towards phosphors in corresponding pixels of faceplate structure 42. As the electrons strike the phosphors, they emit light to form an image on the exterior surface of the faceplate. For color operation, each phosphor pixel contains three phosphor sub-pixels that respectively emit blue, red, and green light upon being struck by electrons emitted from electron-emissive elements in three corresponding sub-pixels formed over the baseplate.

When, as occurs in an FED or a vacuum fluorescent display, the sealed enclosure eventually formed with components 40–46 is maintained at a high vacuum, a getter (not shown) is normally located inside the display for collecting gases that might otherwise degrade the display during normal display operation. Likewise, when the flat-panel device is a plasma display in which the sealed enclosure contain an inert gas such as xenon, neon, helium, krypton, or/and argon for forming a plasma, a getter can be located in the enclosure. Cho et al, U.S. patent application Ser. No. 08/766,453, filed Dec. 12, 1996, now allowed, the contents of which are incorporated by reference herein, presents locations for such a getter and describes how it is activated through local light energy transfer.

At the initial stage depicted in FIG. 2*a*, display components 40–46 are all separate from one another. In FIG. 2*a*, the four sub-walls of outer wall 44 are shown as being connected to form wall 44. However, if outer wall 44 is not formed as a single unit, the four outer sub-walls can be separate from one another at this stage.

Display components 40–46 are hermetically sealed together as shown in FIG. 2*b* to form a display compartment 50 in which outer wall 44 is sandwiched between baseplate structure 40 and faceplate structure 42. The sealing operation is performed in such a way that edges 44A and 44B of outer wall 44 are joined directly to interior surfaces 40A and 42B of plate structures 40 and 42. Pump-out tube 46 is sealed through frit 52 to baseplate structure 40 along exterior surface 40E above opening 48. As so sealed, pump-out tube 46 is located laterally outside active area 54 of the display. Active area 54 for a flat-panel CRT display is the region in which electrons move from baseplate structure 40 to faceplate structure 42 to activate phosphors for producing an image. The getter (unshown) is located in a portion of display compartment 50 situated to the side of active area 54, typically below pump-out opening 48.

The hermetic sealing of display components 40–46 can be performed in various ways and in various sequences. For example, plate structures 40 and 42 can be aligned and sealed to outer wall 44 after which pump-out tube 46 is aligned and sealed to baseplate structure 40. Alternatively, tube 46 can be aligned and sealed to baseplate structure 40 after which plate structures 40 and 42 are aligned and sealed to outer wall 44.

Plate structures 40 and 42 can be sealed to outer wall 44 in one operation or in a pair of separate sealing operations. The getter is generally inserted between plate structures 40 and 42 before sealing them to outer wall 44. If any spacers are employed in the flat-panel display, the spacers are placed between plate structures 40 and 42 before sealing them to outer wall 44. The combination of pump-out tube 46, opening 48, and frit 52 forms a port for accessing compartment 50 formed with components 40–44.

Regardless of the sequence employed for sealing display components 40–46 to one another, the sealing of plate structures 40 and 42 to outer wall 44 is performed by raising the material of wall 44 along edges 44A and 44B to a sealing temperature equal to or slightly greater than the melting temperature of that wall material. The material of wall 44 along edges 44A and 44B wets the corresponding sealing areas along interior surfaces 40A and 42B of plate structures 40 and 42 and flows to form seals along interior surfaces 40A and 42B. Depending on whether the sealing of outer wall 44 to plate structures 40 and 42 is done by local energy transfer (e.g., with a laser) or by global heating (e.g., in an oven), other parts of the display may be raised to the sealing temperature. If so, none of these other parts of the display is damaged by being raised to the sealing temperature.

In a typical example, display components 40–46 are aligned to one another and appropriately brought into contact using a suitable alignment fixture. If any spacers, typically spacer walls, are to be used in the flat-panel display, the spacers are appropriately placed between plate structures 40 and 42 before both of structures 40 and 42 are brought into contact with outer wall 44. Frit 52 lies between baseplate structure 40 and outer wall 44. The alignment of plate structures 40 and 42 is performed optically using alignment marks provided on structures 40 and 42.

With display components 40–46 and 52 placed in a vacuum oven, the pressure in the oven is pumped down to a high vacuum, typically $10^{-7}$ torr. Components 40–46 are appropriately sealed to one another by globally heating them to a sealing temperature at least as high as the melting temperature of frit 52 and the frit along outer wall edges 44A and 44B. The sealing temperature is typically in the vicinity of 400–550° C. The temperature ramp-up step during the global heating is typically performed at a ramp-up rate in the range of 3–5° C./min. The temperature rampdown is similarly performed at a ramp-down rate in the range of 3–5° C./min.

After the global heating is complete, the pressure in the vacuum oven is returned to room pressure, and the partially finished structure formed with components 40–46 and 52 is removed from the sealing oven. The term "room pressure" here means the external atmospheric pressure, normally in the vicinity of 1 atm. depending on the altitude.

The partially finished flat-panel display formed with components 40–46 and 52 is placed in a vacuum chamber 56 connected through an (unshown) opening to a tube 58T of a vacuum pumping system 58. Vacuum chamber 56 is also connected through another (unshown) opening to a tube 60T of a dry nitrogen source 60 having a valve 60V that controls the flow of dry nitrogen from a nitrogen supply tank 60S. Chamber 56 is then closed. Immediately after being placed in vacuum chamber 56, the flat-panel display is typically at or close to room temperature, while display compartment 50 and vacuum chamber 56 are normally at room pressure. The term "room temperature" here means the external (usually indoor) atmospheric temperature, typically in the vicinity of 20–25° C.

With nitrogen valve 60V closed, a vacuum pump 58P in vacuum pumping system 58 is activated to pump compartment 50 from room pressure down to a low pressure, typically a high vacuum. See FIG. 2*c*. Specifically, pumping system 58 pumps vacuum chamber 56 down to a pre-attachment pressure no greater than 0.1 atm., preferably no greater than $10^{-2}$ torr, typically $10^{-7}$ torr. As used here, the terms "pre-attachment" and "post-attachment" refer to operations respectively performed before and after attaching exterior support structure to the flat-panel display in the manner described below.

Inasmuch as compartment 50 is connected through port 46/48/52 to the inside of vacuum chamber 56, pumping chamber 56 down to the low pre-attachment pressure causes the pressure in compartment 50 to be simultaneously reduced to approximately the same low pre-attachment value. The pump-down is controlled so that no significant pressure differential is produced across either of plate structures 40 and 42 or across any of other display components 44, 46, and 52.

While the flat-panel display is in vacuum chamber 56, a pre-attachment bake operation is performed on the display to cause contaminant gases to outgas from components 40–46 and 52. The pre-attachment bake operation entails heating the display to a bake temperature of 250–500° C., typically 350° C., at approximately a linear ramp-up rate no greater than 3–5° C./min. using a suitable heating mechanism (not shown). The display is held at the pre-attachment bake temperature for a "soak" period of 0.5–2 hrs., typically 1 hr. The pre-attachment bake temperature is high enough to produce substantial outgassing from components 40–46 and 52 without significantly damaging them.

Importantly, the pre-attachment bake temperature is normally considerably greater than the maximum temperature reached during the post-attachment bake operation described below that follows the attachment of exterior support structure to the flat-panel display. In particular, the value of the pre-attachment bake temperature can be high enough to cause damage to the exterior support structure or/and any material that bonds the exterior support structure to the display. However, such a high value for the pre-attachment bake temperature does not result in any actual damage to the display since the display has not yet been provided with the exterior support structure.

The bake operation is completed by cooling the flat-panel display down to room temperature. The cool down to room temperature is controlled so as to avoid having the instantaneous cool-down rate exceed a value in the range of 3–5° C./min. Inasmuch as the natural cool-down rate at the beginning of the thermal cool down normally exceeds 3–5° C./min., heat is applied during the initial part of the cool down to maintain the cool-down rate approximately at the selected value in the range of 3–5° C./min. The heating is progressively decreased until a temperature is reached at which the natural cool-down rate is approximately at the selected value after which the display is normally permitted to cool down naturally at a rate that progressively decreases to zero.

Part of the contaminant gases outgas into compartment 50 during the pre-attachment bake operation. Pumping with pumping system 58 is continued during the pre-attachment bake to maintain compartment 50 close to the low pre-attachment pressure mentioned above and, thus, to help remove the contaminant gases from compartment 50 during the pre-attachment bake. In particular, the pumping is performed during the temperature ramp-up, during the soak time at the pre-attachment bake temperature, and during the subsequent cool down. The net result is that a very large portion of the contaminant gases that outgas into compartment 50 during the pre-attachment are removed from compartment 50 by pumping system 58.

After the flat-panel display has cooled down to a temperature close to room temperature, valve 60V of nitrogen source 60 is opened to permit nitrogen to enter vacuum chamber 56. See FIG. 2*d*. Simultaneously or shortly afterwards, pumping system 58 is de-activated. Consequently, nitrogen substantially fills chamber 56. Part of the nitrogen enters compartment 50 through port 46/48/52 to simultaneously fill compartment 50 with nitrogen. The back fill with nitrogen is continued until the pressure in chamber 56 and compartment 50 is approximately room pressure.

During the nitrogen back fill, no significant pressure differential is produced across either of plate structures 40 and 42 or across any of other display components 44, 46, and 52. Further steps can now be performed on the flat-panel display at room pressure—i.e., with the pressure outside the display at the room value—without causing the display to collapse due to a significant pressure differential across any of display components 40–46 and 52.

Nitrogen does not significantly react with any of display components 40–46 and 52 when they are raised to the temperatures of later steps in the process of FIG. 2. Consequently, no significant damage to the display occurs during later process steps due to the nitrogen in compartment 50. By filling compartment 50 with nitrogen and maintaining the nitrogen in compartment 50 during the attachment of exterior support structure to the flat-panel display, sensitive display elements along the inside of compartment 50, especially electron-emissive elements along interior surface 40A of baseplate structure 40 in the case of an FED, are not subjected to significant amounts of highly reactive air components, such as oxygen, that could damage these display elements during the steps involved in attaching the exterior support structure.

Vacuum chamber 56 is subsequently opened. The flat-panel display is removed from chamber 56. In taking the display out of chamber 56, a flow of nitrogen may be maintained on the display, particularly on the open end of pump-out tube 46, to prevent air from entering compartment 50. Accordingly, compartment 50 remains substantially filled with nitrogen. The outside of the display is now approximately at room pressure.

A temporary cap 62 may be quickly placed on the open end of pump-out tube 46 as shown in FIG. 2*e*. This prevents air from entering compartment 50 as well as preventing nitrogen from leaving compartment 50. Instead of cap 62, pump-out tube 46 can be closed with a plug that goes partway into tube 46. With tube 46 closed, the display is now ready for the attachment of exterior support structure to the outside of the display for increasing its resistance to bending and enhancing its strength. Because compartment 50 is closed and also filled with nitrogen at room pressure, the exterior support structure can be attached to the display in a room-pressure air manufacturing facility without significantly subjecting the active display elements along the inside of compartment 50 to oxygen or other reactive air components that could degrade or destroy these display elements.

FIG. 2*f* illustrates an example in which the exterior support structure consists of a pair of support structures 64 and 66. Support structures 64 and 66 may be configured in various ways and may consist of various materials. For this reason, support structures 64 and 66 are shown generally in FIG. 2*f*. Embodiments for particular configurations of support structures 64 and 66 are given below.

Support structure 64 is attached to baseplate structure 40 along exterior surface 40E. In the illustrated example, the attachment of baseplate support structure 64 to baseplate structure 40 is accomplished with a layer 68 of bonding material. Bonding layer 68 is present largely wherever baseplate support structure 64 directly adjoins baseplate structure 40—i.e., wherever support structure 64 would substantially touch baseplate structure 40 if bonding material 68 were not present. Display components 40, 64, and 68 now form a strengthened composite baseplate structure 40/64/68.

In the example of FIG. 2*f*, baseplate support structure 64 has an opening 70 through which pump-out tube 46 protrudes. Baseplate support structure 64 could, however, be situated to the side of tube 46. Support structure 64 normally overlies at least 50% of exterior baseplate surface area 40E. It is normally desirable that baseplate structure 64 overlie all of active device area 54. Preferably, baseplate support structure 64 overlies all, or nearly all, of compartment 50.

Support structure 66 is attached to faceplate structure 42 along exterior surface 42E. In the illustrated example, the attachment of faceplate support structure 66 to faceplate structure 42 is accomplished with a layer 72 of bonding material. Bonding layer 72 is present substantially wherever faceplate support structure 66 directly adjoins faceplate structure 42—i.e., wherever support structure 66 would substantially touch faceplate structure 42 in the absence of bonding layer 72. Display components 42, 66, and 72 now form a strengthened composite faceplate structure 42/66/72.

Faceplate support structure 66 normally overlies at least 50% of exterior faceplate surface area 42E. While support structure 66 actually underlies faceplate structure 40 in the orientation depicted in FIG. 2*f*, the terms "overlie", "overlying", and the like are employed here to describe the relative relationship of support structure 66 to the display in the sense that support structure 66 is provided over the outside of the display. To avoid degrading the image seen by the viewer, faceplate support structure 66 preferably overlies all of active display area 54. The exterior surface of support structure 66 thus provides the viewing surface for the flat-panel display. Preferably, faceplate support structure 66 overlies all, or nearly all, of compartment 50.

Support structures 64 and 66 provide the flat-panel display with strength so as to eliminate, or substantially reduce, the need for inserting spacers between plate structures 40 and 42 to prevent the display from collapsing due to air pressure and other external forces. The thickness of each of support structures 64 and 66 depends on various factors such as the thicknesses and mechanical strengths of plate structures 40 and 42, the mechanical strengths of support structures 64 and 66, the size of active area 54, the diagonal length of the display, and the number, configuration, and placement of spacers (if any) between plate structures 40 and 42.

Typically, baseplate support structure 64 is considerably thicker than baseplate structure 40. For example, the average thickness of baseplate support structure 64 is typically 1–50 mm. Likewise, faceplate support structure 66 is considerably thicker than faceplate structure 42. The average thickness of faceplate support structure 66 is typically 1–50 mm.

Attachment of baseplate support structure 64 to baseplate structure 40 in the exemplary process of FIG. 2 is typically accomplished by forming a blanket layer of liquid bonding material on exterior baseplate surface 40E or/and on the intended bonding surface of support structure 64, bringing support structure 64 and surface 40E sufficiently close together to eliminate space between them along the intended bonding interface, and processing the flat-panel display to convert the liquid bonding material into solid bonding layer 68. These operations are performed while the display is internally and externally at room pressure.

The liquid bonding material may be liquid at room temperature or may be a room-temperature solid, such as a thermoplastic material, that is converted to liquid form by heating (i.e., melted). Depending on the properties of the bonding material, conversion of the liquid bonding material into solid layer 68 may entail simply permitting the liquid bonding material to dry for a suitable time. If the liquid bonding material is thermosetting, the display is raised to the necessary thermosetting temperature to convert the liquid bonding material into solid layer 68. Ultraviolet light may also be utilized to cure the liquid bonding material.

Attachment of faceplate support structure 66 to faceplate structure 42 in the exemplary process of FIG. 2 is performed generally in the same way while the flat-panel display is internally and externally at room pressure. That is, a blanket layer of liquid bonding material is typically formed on exterior faceplate surface 42E or/and the intended bonding surface of support structure 66 after which support structure 66 and surface 42E are brought sufficiently close together to eliminate space between them along the intended bonding interface, and the display is processed to convert the liquid bonding material into solid bonding layer 72. The techniques described above for converting liquid bonding material into solid bonding layer 68 may be utilized in converting the liquid bonding material here into solid bonding layer 72.

Bonding layers 68 and 72 may consist simply of glue such as Sylgard 184 silicon rubber. Other materials that may be used to form bonding layers 68 and 72 include Tra-Con BA-F113 two-part epoxy.

Support structures 64 and 66 may be attached to the flat-panel display at the same time. Alternatively, one of support structures 64 and 66 may be attached to the display before the other. For the case in which baseplate support structure 64 is mounted on the display before faceplate support structure 66, FIG. 2*f*1 depicts how the display appears between the steps of FIGS. 2*e* and 2*f*. FIG. 2*f*2 depicts how the display appears between the steps of FIGS. 2*e* and 2*f* when faceplate support structure 66 is mounted on the display before baseplate support structure 64.

Subsequent to the pre-attachment bake operation described above, the flat-panel display is normally not raised to a temperature of 250° C. or higher. As a result, support structures 64 and 66 can consist of materials that degrade at a temperature of 250° C. or more. The same applies to bonding layers 68 and 72.

Importantly, none of support structures 64 and 66 and bonding layers 68 and 72 are subjected to the even higher temperatures that occur during the pre-attachment bake operation and during the sealing of plate structures 40 and 42 to outer wall 44. Nor are any of components 64–68 and 72 subjected to the high temperatures which typically occur during the fabrication of plate structures 40 and 42. By having the sequence of steps in the process of FIG. 2 arranged so that components 64–68 and 72 are not subjected to a temperature of 250° C. or higher, wide ranges of materials are available for support structures 40 and 42 and bonding layers 68 and 72. The sequence of steps in the process of FIG. 2 thus provides considerable flexibility.

The attachment of support structures 64 and 66 nearly completes the flat-panel display manufacture. Cap 62 (when used) is subsequently removed from pump-out tube 46, and a tube 74T of a vacuum pumping system 74 is quickly connected to tube 46. See FIG. 2*g*. A flow of nitrogen may be maintained over the display, especially over pump-out tube 46, during the cap-removal/vacuum-system-connection process to prevent air from entering display compartment 50 and possibly damaging the active display elements.

After tube 74T is attached to pump-out tube 46, a vacuum pump 74P in pumping system 74 is activated to pump compartment 50 down to a low pressure, typically a high vacuum. In particular, pumping system 74 pumps compartment 50 down to a low post-attachment pressure no greater than 0.1 atm., preferably no greater than $10^{-2}$ torr, typically $10^{-7}$ torr.

The pressure outside the flat-panel display is at approximately room value during the post-attachment pump down. Accordingly, a pressure differential in the vicinity of 1 atm. is produced across each of composite plate structures 40/64/68 and 42/66/72 and across each of other display components 44, 46, and 52. The enhanced bending resistance provided by support structures 64 and 66, as assisted by any spacers situated between plate structures 40 and 42, furnishes the display with strength to prevent the approximate 1-atm. pressure differential from collapsing composite plate structures 40/64/68 and 42/66/72 and destroying the display.

Pumping system 74 is normally part of an oven (not shown) into which the nearly finished flat-panel display of FIG. 2*g* is placed prior to the attachment of tube 74T. With the flat-panel display at the low post-attachment pressure, a post-attachment bake operation is performed on the display to cause further contaminant gases to outgas from display components 40–46 and 52, and typically also from support structures 64 and 66 and bonding layers 68 and 72. The post-attachment bake entails heating the display to a bake temperature of 100–250° C., typically 180° C., at an approximately linear ramp-up rate no greater than 0.5–5° C./min. The flat-panel display is then held at the bake temperature for a soak period of 1–7 hrs., typically 2 hrs. The post-attachment bake temperature is sufficiently low that no damage occurs to any of display components 64–68 and 72. The post-attachment bake temperature is, of course, not high enough to damage any of components 40–46 and 52.

The flat-panel display is subsequently cooled down to room temperature. The cool down is performed in the manner described above for the pre-attachment cool down except that the minimum value of the cool-down rate is 0.5° C./min. rather than 3° C./min. Consequently, the cool-down rate normally does not exceed a value in the range of 0.5–5° C./min.

A relatively small amount of contaminant gases typically outgas into display compartment 50 during the post-attachment bake. Pumping with system 74 is continued during the post-attachment cool down to maintain compartment 50 in the vicinity of the low post-attachment pressure specified above. In particular, the pumping with system 74 is performed during the temperature ramp-up, during the soak time at the bake temperature, and during the subsequent cool down. Nearly all of any contaminant gases in compartment 50 are removed during the post-attachment pumping. The getter may be activated during the post-attachment bake to collect part of the contaminant gases in compartment 50 and effectively remove them from compartment 50.

When the post-attachment cool down is complete, pump-out tube 46 is closed with a suitable heating element while pumping system 74 continues pumping with tube 74T attached to pump-out tube 46. A heating element (not shown) applies heat to pump-out tube 46 at a location below tube 74T close to the top of baseplate support structure 64. The heat causes pump-out tube 46 to soften. With a pressure differential of approximately 1 atm. existing between the outside and inside of pump-out tube 46, the approximate 1-atm. pressure differential causes the wall of tube 46 to collapse inward until tube 46 closes at a location near the top of support structure 64.

During the pump-out tube closure, pump-out tube 46 separates into two pieces so as to disconnect the flat-panel display from tube 74T. The display is removed from the oven to produce the final structure shown in FIG. 2*h*. Item 46A in FIG. 2*h* indicates the remainder of pump-out tube 46. Due to the technique employed to close tube 46, remaining tube portion 46A does not extend significantly further away from baseplate structure 40 than baseplate support structure 64.

The display manufacturing process of FIG. 2 can be modified in various ways. Instead of attaching baseplate support structure 64 to baseplate structure 40 by way of bonding layer 68, support structure 64 can be attached directly to baseplate structure 40. Physically, the direct attachment normally occurs largely wherever support structure 64 substantially adjoins baseplate structure 40.

Direct attachment of baseplate support structure 64 to baseplate structure 40 can be accomplished by implementing support structure 64 with a substantially rigid structure that is processed to produce liquid material along the area where support structure 64 is to be attached directly to exterior surface 40E of baseplate structure 40. Depending on the constituency of support structure 64, the formation of this part of structure 64 in liquid form can be performed by appropriately heating at least the part of structure 64 where it is intended to contact exterior baseplate surface 40E. After the liquid part of the support structure 64 is brought into contact with exterior baseplate surface 40E, the liquid material is further processed to cause it to become rigid. This may entail simply drying the liquid part of support structure 64 or performing an active hardening operation.

Direct attachment of baseplate support structure 64 to baseplate structure 40 can alternatively be accomplished by depositing support structure 64 in liquid form on exterior baseplate surface 40E and then processing the liquid to cause it to become rigid. A ring can be placed around the deposition area on exterior surface 40E to prevent the liquid from running off. The ring can be left in place or removed. Conversion of the liquid to rigid form can be performed by simply drying the liquid or by performing an active hardening operation. The liquid that forms baseplate support structure 64 can, for example, consist of epoxy that chemically hardens when mixed. The liquid can also be a material that is cured with ultraviolet light or a thermoplastic material that solidifies upon being raised to a suitably elevated temperature.

Similarly, faceplate support structure 66 can be directly attached to faceplate structure 42 instead of being connected to faceplate structure 42 through bonding layer 72. Physically, the direct attachment normally occurs largely wherever faceplate support structure 66 substantially adjoins faceplate structure 42.

As with baseplate support structure 64 and baseplate structure 40, direct attachment of faceplate support structure 66 to faceplate structure 42 can be accomplished by implementing support structure 66 with a substantially rigid structure that is processed to produce liquid material along the area where support structure 66 is to be directly attached to exterior surface 42E of faceplate structure 42. After the liquid part of support structure 66 is brought into contact with exterior faceplate surface 42E, the liquid material is converted into rigid form. Alternatively, support structure 66 can be attached to faceplate structure 42 by depositing support structure 66 in liquid form on exterior faceplate surface 42E and then processing the liquid to convert it to rigid form. The particular examples given above for directly attaching baseplate support structure 64 to baseplate structure 40 generally apply to attaching faceplate support structure 66 directly to faceplate structure 42.

The step of temporarily closing (capping) pump-out tube 46 to prevent air from entering compartment 50 during the attachment of support structures 64 and 66 can be deleted from the fabrication process of FIG. 2. When this is done, the attachment of support structures 64 and 66 to the flat-panel display is typically performed quickly while the partially finished display is in a room-pressure air environment after which tube 74T of vacuum pumping system 74 is quickly attached to pump-out tube 46, and compartment 50 is pumped down to the desired high vacuum level. By performing these operations sufficiently fast, very little, essentially zero, oxygen or other reactive air components enter compartment 50 and damage the active display elements along the inside of compartment 50.

Alternatively, the flat-panel display can be maintained in a dry nitrogen environment from the end of the pre-attachment bake operation to the final closing of pump-out tube 46, including the steps involved in attaching support structures 64 and 66 to the display. In this case, the step of actively filling compartment 50 with nitrogen provided from nitrogen source 60 can be deleted along with the temporary closing of pump-out tube 46.

The manufacturing process of FIG. 2 can be varied by deleting one of support structures 64 and 66, provided that plate structure 40 or 42 not covered by exterior support structure is sufficiently thick (and strong) to withstand air pressure and other external forces to which the flat-panel display is subjected during handling, storage, display operation, and manufacturing steps in which the pressure in compartment 50 is significantly less than the pressure immediately outside the display.

Specifically, the resistance to bending of the material, whether solely the plate-structure material or the combination of the plate-structure material and the exterior-support-structure material, along each interior surface 40A or 42B of compartment 50 must equal or exceed a certain minimum value to prevent the display from collapsing due to external forces applied to compartment 50. The minimum bending resistance value, which is the same for the material along both of interior surfaces 40A and 42B, depends on the magnitude of the forces applied to compartment 50 and on the number, configuration, and arrangement of spacers (if any) inserted between plate structures 40 and 42. When one of support structures 64 and 66 is absent, the bending resistance of plate structure 40 or 42 not covered by exterior support structure must thus equal or exceed the minimum bending resistance value. The bending resistance of other plate structure 42 or 40 and the overlying exterior support structure must, of course, also equal or exceed the minimum bending resistance value.

FIG. 2*f*1 depicts the alternative to the step of FIG. 2*f* for which the flat-panel display is provided with baseplate support structure 64 but not faceplate support structure 66. FIG. 2*h*1 illustrates how the final display appears when faceplate support structure 66 is absent. Although not indicated in FIGS. 2*f*1 and 2*h*1 (relative to FIGS. 2*f* and 2*h*), faceplate structure 42—i.e., primarily the faceplate itself—is normally of considerably greater thickness when faceplate support structure 66 is absent than when it is present.

Similarly, FIG. 2*f*2 depicts the alternative to the step of FIG. 2*f* for which the flat-panel display is provides with faceplate support structure 66 but not baseplate support structure 64. FIG. 2*h*2 illustrates how the final display appears when baseplate support structure 64 is absent. Although not indicated in FIGS. 2*f*2 and 2*h*2 (again relative to FIGS. 2*f* and 2*h*), baseplate structure 40—i.e., primarily the baseplate itself—is normally of considerably greater thickness when baseplate support structure 64 is absent than when it is present.

Each of support structures 64 and 66 can, as mentioned above, be configured in various ways. FIGS. 3.1–3.9 (collectively "FIG. 3") present examples of nine general plan-view configurations for baseplate support structure 64 in accordance with the invention. Item 46A in FIG. 3 represents the appearance of pump-out tube remainder 46A in opening 70 at the stage shown in FIG. 2*f*. FIGS. 3.7–3.9 depict multi-layer configurations for support structure 64. FIGS. 4.1–4.3 (collectively "FIG. 4") illustrate how the flat-panel display of FIG. 2*h* appears when the configurations of support structure 64 in FIGS. 3.7–3.9 are respectively employed in the display.

In FIG. 3.1, baseplate support structure consists simply of a rectangular sheet of solid material of uniform thickness. The material is typically glass, plastic, or a polymer such as polycarbonate. The material in support structure 64 of FIG. 3.1 can be another type of dielectric such as ceramic. Electrically non-insulating material, such as metal, can also be employed for support structure 64 in FIG. 3.1.

In FIG. 3.2, baseplate support structure 64 is formed with a rectangular sheet of porous material of uniform thickness. Items 80 in FIG. 3.2 indicate pores in support structure 64. The porous material is typically metal foam, fiberglass, or porous ceramic.

In FIG. 3.3, baseplate support structure 64 consists of a group of uniformly thick parallel laterally separated bars (or stripes) 82 that occupy a rectangular area. Bars 82 can be formed with glass, plastic, a polymer such as polycarbonate, another dielectric such as ceramic, or electrically non-insulating material such as metal. Bars 82 can also be formed with porous material. Items 84 in FIG. 3.3 are channels between bars 82. Channels 84 can be partly or wholly filled with material different from that utilized for bars 82.

In FIG. 3.4, baseplate support structure 64 is formed with a rectangular uniformly thick plate through which an array of rows and columns of openings 86 extend. In essence, support structure 64 in FIG. 3.4 consists of a group of parallel laterally separated bars 88 extending generally perpendicular to another group of parallel laterally separated bars 90. Bars 88 and 90 can be formed with any of the materials, solid or porous, given above for bars 82 in support structure 64 of FIG. 3.3. Also, openings 86 can be partly or wholly filled with material different from that employed for crossing bars 88 and 90.

In FIG. 3.5, baseplate support structure 64 consists of a rectangular honeycomb plate 92 of uniform thickness. As with support structure 64 in FIG. 3.4, honeycomb plate 92 can be formed with any of the materials given above for bars 82. Items 94 in FIG. 3.5 indicate openings through support structure 64 that produce the honeycomb matrix. Openings 94 can be partially or wholly filled with material different from that utilized for honeycomb plate 92.

In FIG. 3.6, baseplate support structure 64 is formed with a printed circuit board ("PCB") on which electronic components 96 are mounted. Electronic components 96 are interconnected by electrically conductive traces (not shown). Components 96 variously consist of resistors, capacitors, discrete transistors, monolithic integrated circuits, thin-film devices, hybrid devices, and the like.

In FIGS. 3.7 and 4.1, baseplate support structure 64 consists of a lower rectangular plate 100 of uniform thickness and an upper group of parallel laterally separated bars 102 likewise of uniform thickness. Lower plate 100 and upper bars 102 can be formed with the same material or with different materials. In the latter case, bars 102 may directly contact plate 100 or may be bonded to plate 100 through suitable bonding material (not shown). Plate 100 and bars 102 can each variously consist of glass, plastic, a polymer such as polycarbonate, another dielectric such as ceramic, or electrically non-insulating material such as metal. Items 104 in FIGS. 3.7 and 4.1 indicate exposed channels between bars 102.

In FIGS. 3.8 and 4.2, baseplate support structure 64 is formed with a lower group of parallel laterally separated bars 106 of uniform thickness and an upper rectangular plate 108 likewise of uniform thickness. Support structure 64 in FIGS. 3.8 and 4.2 is thus basically the opposite of support structure 64 in FIGS. 3.7 and 4.1. The comments made about the materials and constituency of plate 100 and bars 102 apply to bars 106 and plate 108 here. Items 110 in FIGS. 3.8 and 4.2 indicate covered channels between bars 108.

In FIGS. 3.9 and 4.3, baseplate support structure 64 consists of a lower rectangular plate 112 of uniform thickness, an intervening group of parallel laterally separated bars 114 of uniform thickness, and an upper rectangular plate 116 of uniform thickness. Lower plate 112, intermediate bars 114, and upper plate 116 can all be formed of the same material. Typically, bars 114 consists of different material from one or both of plates 112 and 116. In this case, bars 114 may directly contact one or both of plates 112 and 116, or may be bonded to one or both of plates 112 or 116 through suitable bonding material (not shown). Plate 112, bars 114, and plate 116 can each consist of glass, plastic, a polymer such as polycarbonate, another dielectric such as ceramic, or electrically non-insulating material such as metal. Items 118 in FIGS. 3.9 and 4.3 indicate covered channels between bars 114.

Baseplate support structure 64 can be configured in many other ways besides those shown in FIGS. 3 and 4. For example, support structure 64 can consist of a group of rings, typically circular and concentric. Channels 104, 110, or 118 can be partially or wholly filled with suitable material. Support structure 64 can be formed with two or more rectangular plates, any of which are porous. Support structure 64 can consist of a lower group of parallel bars, an intermediate rectangular plate, and an upper group of parallel bars typically extending either parallel to, or perpendicular to, the lower bars. When baseplate support structure 64 contains a printed circuit board, support structure 64 can also include one or more plates and/or one or more groups of parallel bars, all of which underlie the PCB.

One common factor among the embodiments of FIGS. 3 and 4 and the further embodiments is that bonding material layer 68 is normally present largely wherever support structure 64 directly adjoins baseplate structure 40—i.e., largely wherever support structure 64 would touch, or nearly touch, baseplate structure 40 if bonding layer 68 were absent. Bonding layer 68 may be present or absent at locations above baseplate structure 40 where baseplate support structure 64 does not directly adjoin baseplate structure 40. For example, bonding layer 68 may be present or absent at the locations of channels 84 and 110 and at the locations of openings 86 and 94 when they are otherwise empty.

As indicated above, bonding layer 68 may be deleted so that baseplate support structure 64 is directly attached to baseplate structure 40. In this case, layer 100 in FIG. 4.1 is attached to baseplate structure 40 largely wherever they substantially touch. The same applies to bars 106 and layer 112 respectively in FIGS. 4.2 and 4.3.

Certain of the embodiments described above for baseplate support structure 64 can be generally utilized for faceplate support structure 66, provided that no distortion or other unpleasantness occurs in the image seen on the exterior surface of faceplate support structure 66 due to the particular configuration of support structure 66. Also, faceplate support structure 66 may not have an opening corresponding to opening 70.

As one example, faceplate support structure 66 can be configured as a transparent solid single-layer plate of the type shown in FIG. 3.1. Support structure 66 can likewise consist of two or more transparent solid plates. Support structure 66 can be configured as multiple transparent bars of the type shown in FIG. 3.3 provided that the bars do not distort the image visible on the exterior of support structure 66. The bars can, or example, be situated between columns (or rows) of pixels. The channels between the bars can also be filled with material of largely the same optical properties—primarily refractive index—as the bars.

Similarly, faceplate support structure 66 can be configured as transparent crossing bars of the type shown in FIG. 3.4 or as a transparent honeycomb of the type shown in FIG. 3.5. When support structure 66 is formed as crossing bars either the crossing bars or the openings between the crossing bars can overlie the pixels. When the openings overlie the pixels, the viewing angle is restricted to provide viewing privacy. The openings in the crossing-bar structure or in the honeycomb structure can also be filled with material of largely the same optical properties as the bars or honeycomb.

FIGS. 5.1—5.3 (collectively "FIG. 5") generally depict three exemplary ways of configuring faceplate support structure 66 according to the invention. The embodiments shown in FIG. 5 illustrate how the flat-panel display appears at the stage of FIG. 2*h*.

In FIG. 5.1, faceplate support structure 66 is formed with a rectangular layer of transparent material 120 of one type having channels or openings filled with transparent material 122 of another type. Materials 120 and 122 are of uniform thickness. The cross section of FIG. 5.1 can thus correspond to the plan view of any of FIGS. 3.3–3.5. Materials 120 and 122 variously are glass, transparent plastic, a polymer such as transparent polycarbonate, or another transparent dielectric. Materials 120 and 122 have largely the same optical properties.

In FIG. 5.2, faceplate support structure 66 consists of a transparent lower rectangular plate 124 of uniform thickness and an upper rectangular plate 126 of uniform thickness. While plate 124 actually lies above plate 126 in the orientation of FIG. 5.2, plate 124 is the lower plate since it is closer to exterior faceplate surface 42E than plate 126. Plates 124 and 126 normally consist of different materials. Glass, transparent plastic, a polymer such as transparent polycarbonate, or another transparent dielectric can variously be employed for plates 124 and 126.

In FIG. 5.3, faceplate support structure 66 is formed with a transparent lower layer 128, a transparent intermediate layer 130, and a transparent upper layer 132 that functions as an anti-reflective coating. Each of layers 128–132 is rectangular in shape and of uniform thickness. Although layers 128 and 132 may consist of the same material, layer 130 is normally formed with different material from, or to a different thickness than, layers 128 and 132. In a typical embodiment, lower layer 128 is a thin plate of glass, intermediate layer 130 is a thick plate of plexiglass, polycarbonate, or glass, and upper layer 132 is a thin plate of glass or plastic.

While certain of the components of support structures 64 and 66 in FIGS. 3–5 have been described as being of uniform thickness, the thickness of these components can vary from point to point depending on various factors. The bars in each layer of bars in FIGS. 3–5, although illustrated as being of approximately the same width, can vary in width from one bar to another. The same applies to the channels in each layer of channels in FIGS. 3–5.

A pump-out port for a flat-panel display manufactured generally according to the inventive process of FIG. 2 can be provided through outer wall 44 rather than through one of plate structures 40 and 42. FIG. 6 illustrates an example of such a side-port flat-panel display provided with exterior support structure according to the invention. In the display of FIG. 6, a pump-out port 140 extends through an opening 142 in one of the sub-walls of outer wall 44. Pump-out tube 140 is shown in its closed condition in FIG. 6.

In the final flat-panel display of FIG. 2*h*, the display compartment (50) formed with components 40–44 houses the getter. Alternatively, the getter in a flat-panel display provided with exterior support structure for increasing the display's bending resistance according to the invention can be housed in an auxiliary display compartment that adjoins the main display compartment formed with components 40–44. The getter-containing auxiliary compartment is connected to the main compartment by way of one or more openings through components 40–44 so that the two compartments reach substantially the same steady-state pressure.

The getter-containing auxiliary compartment typically overlies, or partially overlies, baseplate structure 40 to the side of exterior support structure provided over baseplate structure 40. The dimensions of the auxiliary compartment are normally chosen so that it does not extend significantly further away from baseplate structure 40 than the exterior support structure. Consequently, the presence of the auxiliary compartment does not significantly increase the amount of handling care that needs to be exercised to avoid damaging the auxiliary compartment and destroying the display. Also, placing the getter in an auxiliary compartment situated over baseplate structure 40 provides the getter with sufficient area to achieve the necessary level of gettering capability while making efficient use of the overall room available for the display in typical applications.

FIGS. 7*a*–7*e* (collectively "FIG. 7") illustrate how a two-compartment flat-panel display is manufactured in accordance with the invention so as to raise the display's bending resistance while eliminating, or substantially reducing, the need for placing spacers between plate structures 40 and 42. Side views are shown in FIG. 7. Side views of the structure at the stages shown in FIGS. 7*b*, 7*d*, and 7*e* are depicted respectively in FIGS. 8*a*–8*c* (collectively "FIG. 8") in a plane perpendicular to that of FIG. 7.

In the process of FIG. 7 and 8, exterior support structure is provided only along exterior surface 40E of baseplate structure 40. Although not indicated in FIGS. 7 and 8 (relative to FIG. 2), faceplate structure 42 in FIGS. 7 and 8 is normally of considerably greater thickness than in FIG. 2. In particular, faceplate structure 42 in FIGS. 7 and 8 is thick enough to prevent the flat-panel display from collapsing due to external forces applied to the display when the pressure in the main and auxiliary compartments is significantly less than the pressure immediately outside the display.

The components of the flat-panel display manufactured in accordance to the process of FIG. 7 include plate structures 40 and 42, outer wall 44, a getter 150, a pair of getter support structures 152, an auxiliary compartment wall 154, and a pump-out tube 156. See FIG. 7*a* in which only one of getter support structures 152 is depicted. Display components 40–44 and 150–156 are all separate from one another at the initial stage shown in FIG. 7*a*. One or more inter-compartment openings 158 extend through baseplate structure 40.

Getter 150 is a strip of gettering material, normally of the non-evaporable type. Each getter support structure 152 is a five-sided thermally (and electrically) insulating member having an opening for receiving one end of getter 150. Auxiliary compartment wall 154 is a five-sided structure having a cavity in which getter 150 and getter support structures 152 are placed. The five sides of wall 154 are a rectangular top side and two pairs of opposing rectangular lateral sides that all meet the top side. Pump-out tube 156 has a constricted portion 156C. Further details on components 150–156 are given in Cho et al cited above.

Display components 40–44 are hermetically sealed together as shown in FIGS. 7*b* and 8*a* to form main compartment 50. Getter supports 152 are mounted on baseplate structure 40 along exterior baseplate surface 40E, getter 150 being inserted between getter supports 152 into their openings. Auxiliary compartment wall 154 is positioned over composite getter structure 150/152 above openings 158 and is sealed to baseplate structure 40 through frit 160 to form auxiliary display compartment 162. Main compartment 50 and auxiliary compartment 162 are interconnected through inter-compartment openings 158, two of which are shown in FIG. 8*a*. Constricted portion 156C of pump-out tube 156 is sealed by way of frit 164 to one lateral side of auxiliary compartment wall 154 at the location of an opening 166 through wall 154. This is particularly shown in FIG. 8*a*. A comparatively small number of spacers (not shown) may be placed between plate structures 40 and 42.

The assembly of display components 40–44 and 150–156 can be performed in various ways and in various sequences. For example, getter supports 152 can be mounted on baseplate structure 40 before or after structure 40 is sealed to outer wall 44. Also, getter supports 152 can be connected to the bottom of the top side of auxiliary compartment wall 154 so that components 150–154 can be produced as a prefabricated unit for connection to baseplate structure 40. Regardless of the sequence used for assembling components 40–44 and 150–156, the sealing of plate structures 40 and 42 to outer wall 44 is performed by raising the material of wall 44 along edges 44A and 44B to a sealing temperature equal to or slightly greater than the melting temperature of that material. The molten material flows to form the requisite seals.

After the sealing/assembly of display components 40–44 and 150–156 is complete, display compartments 50 and 162 are pumped down to a low pre-attachment pressure, typically a high vacuum, in the manner discussed above for the process of FIG. 2 using a vacuum pumping system of the type indicated in FIG. 2*c*. A pre-attachment bake operation is preformed in the manner prescribed for the process of FIG. 2 after which compartments 50 and 162 are back filled with dry nitrogen to approximately room pressure. FIG. 7*c* illustrates the structure at this stage.

The partially finished flat-panel display is disconnected from the vacuum pumping system. A temporary cap 168 may then be placed quickly over the open end of pump-out tube 156 to prevent air from entering compartments 50 and 162. See FIGS. 7*d* and 8*b*. The vacuum-system-disconnection/tube-capping operation can be done while dry nitrogen is flowed over at least the open end of tube 156 to ensure that air does not enter display compartments 50 and 162. The display is now ready to have exterior support structure attached to outside of the display to increase its bending resistance.

In the example of FIGS. 7*d* and 8*b*, the exterior support structure consists of baseplate support structure 64 attached by bonding layer 68 to exterior surface 40E of baseplate structure 40 at a location to the side of auxiliary compartment 162 and pump-out tube 156. Baseplate support structure 64 here consists of a printed circuit board 170 and electronic components 172 interconnected by electrically conductive traces (unshown) situated along the top of PCB 170. Electronic components 172 are utilized to control the operation of the flat-panel display.

Bonding layer 68 is present along substantially the entire undersurface of PCB 170. The attachment of baseplate support structure 64 is performed here in the way described above for the process of FIG. 2. As indicated in FIGS. 7*d* and 8*b*, auxiliary compartment wall 154 does not extend significantly further away from baseplate structure 40 than support structure 64.

Cap 168 is removed from pump-out tube 156, and the open end of tube 156 is quickly connected to a vacuum system of the type indicated in FIG. 2*g*. Nitrogen may be flowed over at least tube 156 to prevent air from entering compartments 50 and 162 during the cap-removal/vacuum-system-connection procedure. Compartments 50 and 162 are pumped down to a low post-attachment pressure, typically a high vacuum, as described above for the process of FIG. 2. A post-attachment bake operation is performed in the manner specified for the process of FIG. 2.

Utilizing a heating element (not shown), pump-out tube 156 is closed at constricted portion 156C while the pumping is continued. The flat-panel display is subsequently removed from the oven that contains the vacuum pumping system. FIGS. 7*e* and 8*c* depict the resulting structure in which item 156A is the closed remainder of pump-out tube 156. Although the widest part of original tube 156 did extend somewhat further away from baseplate structure 40 than auxiliary compartment wall 154, remaining tube portion 156A does not extend significantly further away from baseplate structure 40 than auxiliary compartment wall 154.

The process of FIGS. 7 and 8 can be modified to include the attachment of faceplate support structure 66 to exterior surface 42E of faceplate structure 40. In this case, support structure 66 is attached to faceplate structure 40 at the stage shown in FIGS. 7*d* and 8*b*.

FIGS. 9*a*–9*e* (collectively "FIG. 9") illustrate another process for manufacturing a two-compartment flat-panel display in accordance with the invention so as to enhance the display's bending resistance while substantially reducing or eliminating the need for placing spacers between plate structures 40 and 42. Side views are shown in FIG. 9. Side views of the structure at the stage shown in FIGS. 9*b*, 9*d*, and 9*e* are depicted respectively in FIGS. 10*a*–10*c* (collectively "FIG. 10") in a plane perpendicular to that of FIG. 9.

Similar to the process of FIGS. 7 and 8, exterior support structure is provided only along exterior surface 40E of baseplate structure 40 in the process of FIGS. 9 and 10. Although not indicated in FIGS. 9 and 10 (relative to FIG. 2), faceplate structure 42 in FIGS. 9 and 10 is normally considerably thicker than in FIG. 2. The faceplate support structure thickness in FIGS. 9 and 10 is great enough to prevent the flat-panel display from collapsing due to external forces applied to the display when the pressure in the main and auxiliary compartments is significantly less than the external pressure.

The components of the flat-panel display manufactured according to the process of FIG. 9 include plate structures 40 and 42, outer wall 44, getter 150, two getter support structures 152 of which one is shown in FIG. 9*a*, pump-out tube 156, and an auxiliary compartment wall 180. Display components 40–44, 150, 152, 156, and 180 are all separate from one another at the initial stage shown in FIG. 9*a*. One or more inter-compartment openings 182 extend through one sub-wall of outer wall 44.

Display components 150, 152, and 156 in FIG. 9*a* are configured as described above. Auxiliary compartment wall 180 is a five-sided structure having a cavity in which getter structure 150/152 is situated. The five sides of wall 180 are a rectangular top side, a pair of identical opposing lateral sides each shaped as a rectangle with one corner removed, and a pair of rectangular opposing lateral sides, one of which is taller than the other as indicated in FIG. 9*a*. The lateral sides of wall 180 all meet the top side. Further details on auxiliary compartment wall 180 are given in Cho et al.

Display components 40–44 are hermetically sealed together as shown in FIGS. 9*b* and 10*a* to form main compartment 50. Getter supports 152 are mounted on exterior surface 40E of baseplate structure 40 near or over one edge of structure 40, getter 150 again being inserted between getter supports 152 into their openings. Auxiliary compartment wall 180 is positioned over getter structure 150/152 and is sealed to components 40–44 through frit 184 to form an auxiliary compartment 186. Compartments 50 and 186 are interconnected through inter-compartment openings 182, one of which is shown in FIG. 10*a*. Constricted portion 156C of pump-out tube 156 is sealed by way of frit 164 to one lateral side of auxiliary compartment wall 180 at the location of an opening 188 through wall 180. This is particularly shown in FIG. 10*a*. A comparatively small number of spacers (not shown) may again be placed between plate structures 40 and 42.

The assembly of display components 40–44, 150, 152, 156, and 180 can be performed in various ways and in various sequences. Typically, plate structures 40 and 42 are hermetically sealed to outer wall 44 in the manner described above. Getter structure 150/152 is then mounted on baseplate structure 40 after which auxiliary compartment wall 180 is sealed to components 40–44. Also, getter supports 152 can be connected to the bottom of the top side of wall 180 so that components 150, 152, and 180 can be pre-assembled for connection to components 40–44.

Further processing of the partially finished flat-panel display of FIGS. 9*b* and 10*a* is performed in the manner described above for the partially finished flat-panel display of FIGS. 7*b* and 8*a* with reference symbols 180–188 respectively replacing reference symbols 154, 158–162, and 166. This includes pumping compartments 50 and 186 down to the low pre-attachment pressure, performing the pre-attachment bake operation, back filling compartments 50 and 186 with dry nitrogen to approximately room pressure, attaching the exterior support structure formed with baseplate support structure 64, pumping compartments 50 and 186 to the low post-attachment pressure, performing the post-attachment bake operation, and closing pump-out tube 156. Baseplate support structure 64 here again consists of PCB 170 and electronic components 172 interconnected by electrically conductive traces (unshown) situated along the top of PCB 170. The steps shown in FIG. 9*c* and in FIGS. 9*d* and 10*b* to produce the fully sealed structure of FIGS. 9*e* and 10*c* respectively replace the steps depicted in FIG. 7*c* and in FIGS. 7*d* and 8*b* that lead to the fully sealed structure of FIGS. 7*e* and 8*c*.

The process of FIGS. 9 and 10 can be modified to provide faceplate support structure 66 along exterior surface 42E of faceplate structure 40. In this case, support structure 66 is attached to faceplate structure 42 at the stage shown in FIGS. 9*d* and 10*b*.

Getter-containing auxiliary compartment 186 in the process of FIGS. 9 and 10 typically provides the flat-panel display with some support to resist external forces that could otherwise collapse the display. Since auxiliary compartment 186 is incorporated into the display before the pre-attachment bake, compartment 186 does not constitute part of post-attachment baseplate support structure 64. However, auxiliary compartment 186 can be attached to the display after the pre-attachment bake at the stage generally shown in FIGS. 9*d* and 10*b*. Compartment 186 then forms part of support structure 64. Inasmuch as it would likely be difficult to temporarily cap pump-out opening 182, it would be necessary to attach display components 170 and 180 rapidly to baseplate structure 40 or to perform the attachment operation in a non-reactive environment, such as dry nitrogen, at room pressure. The same applies to getter-containing auxiliary compartment 162 in the process of FIGS. 7 and 8.

The process of FIGS. 7 and 8, or that of FIGS. 9 and 10, can be modified to provide the flat-panel display with multiple getter-containing auxiliary compartments integrated into baseplate support structure 64. FIGS. 11 and 12 depict how the final flat-panel display appears when such a modification is applied to the process of FIG. 7 and 8 and the display is also provided with faceplate support structure 66.

Baseplate structure 64 in the flat-panel display of FIGS. 11 and 12 consists of cavity-containing baseplate support member 190, N getters 192, and 2N getter supports 194, where N is a plural integer. N is 6 in the example of FIGS. 11 and 12. Baseplate support member 190 is attached to exterior surface 40E of baseplate structure 40 through bonding layer 68. In addition to display components 40–44, 64–68, 72, and 190–194, the display of FIGS. 11 and 12 contains a pump-out tube 196 connected to a lateral side of support member 190 by way of frit 198 at the location of a pump-out opening 200 through member 190. Pump-out tube 196 is closed at the stage shown in FIGS. 11 and 12.

N cavities are provided in baseplate support member 190 along its interior surface, each cavity forming an auxiliary compartment 202 with baseplate structure 40. As indicated in FIG. 11, auxiliary compartments 202 are located outside main compartment 50 formed with plate structures 40 and 42 and outer wall 44. Each auxiliary compartment 202 contains one getter 192 and two corresponding getter supports 194 for supporting that getter 192. Each getter 192 is a strip of gettering material, normally of the non-evaporable type. Each getter support 194 is a five-sided thermally (and electrically) insulating structure having an opening for receiving one end of corresponding getter strip 192.

Instead of being mounted on baseplate structure 40 as is done with getter supports 152 in the exemplary embodiment of FIGS. 7 and 8, each getter support 194 in the flat-panel display of FIGS. 11 and 12 is mounted on the bottom of the top side of the portion of baseplate support member 190 used in defining corresponding auxiliary compartment 202. Display components 190–198 then can be provided as a pre-fabricated unit for incorporation into the display.

Auxiliary compartments 202 are pressure-wise interconnected through multiple inter-compartment openings 204. FIG. 12 illustrates one inter-compartment opening 204 for interconnecting each pair of horizontally or vertically adjoining auxiliary compartments. More openings 204 than shown in FIG. 12 can be utilized for interconnecting auxiliary compartments 202. Main compartment 50 is pressure-wise interconnected through one or more inter-compartment openings 206, four of which are shown in FIG. 12 close to the corners of baseplate support member 190. Due to the presence of openings 204 and 206, compartments 50 and 202 reach substantially the same steady-state compartment pressures.

The flat-panel display of FIGS. 11 and 12 is fabricated in the manner generally described above for the process of FIGS. 7 and 8 except that the pre-fabricated unit formed with display components 190–198, of which components 190–194 constitute baseplate support structure 64, is attached to baseplate structure 40 during the period between the pre-attachment bake operation while main compartment 50, and thus also auxiliary compartments 202, are at room pressure, rather than being attached to the display before the pre-attachment bake. Pump-out tube 196 is in its open condition when support member 190 is attached to exterior baseplate surface 40E.

Inasmuch as baseplate support member 190 overlies inter-compartment openings 206 in the final flat-panel display, openings 206 essentially cannot be temporarily closed when support member 190 is attached to exterior baseplate surface 40E. Accordingly, the fabrication process for creating the flat-panel display of FIGS. 11 and 12 employs the process variation in which support structure 64 and 66 are rapidly attached to the display after bringing vacuum chamber 56 up to room pressure and removing the display from chamber 56. Alternatively, the display fabrication process can employ the process variation in which the display is maintained in a dry nitrogen environment from the end of the pre-attachment bake to the final closure of pump-out tube 196.

Active region 54 in an FED manufactured according to the process of any of FIGS. 2 and 6–12 typically includes other components not mentioned above. For example, a black matrix situated along the interior surface of the faceplate normally surrounds each phosphor region to laterally separate it from other phosphor regions. Focusing ridges provided over the inter-electrode dielectric layer help control the trajectories of electrons emitted from the electron-emissive elements.

The teachings of the invention are, as mentioned above, applicable to increasing the strength of many types of flat-panel displays, including both CRT displays and non-CRT displays. Consider how the process of FIG. 2 is modified to produce a plasma display or a plasma-addressed liquid-crystal display having a plasma section. The starting point is again FIG. 2*a* with plate structures 40 and 42 now being plasma-display structures suitable for the cathode and anode of an enclosure in which a plasma is generated.

In the plasma case, display manufacture is performed as described above in connection with FIGS. 2*b*–2*g* up through the steps of pumping display compartment 50 down to the low post-attachment pressure and performing the post-attachment bake operation. Instead of closing pump-out tube 46 after the post-attachment bake is complete, inert gas is back filled into compartment 50 to bring its pressure up to a value ranging from 0.1 torr to approximately 0.5 atm. Pump-out tube 46 is then permanently closed with a suitable heating element as described above. The resulting plasma-display structure appears generally as shown in FIG. 2*h*, except that compartment 50 contains inert gas at the desired pressure, rather than being at a high vacuum.

The inert gas in compartment 50 of the plasma display structure is appropriately converted into a plasma during display operation. For a flat-panel plasma display, the plasma is controlled to selectively emit light that produces an image visible on the exterior surface of faceplate support structure 66. For a plasma-addressed LCD, the plasma functions as a group of address switches that selectively activate different parts of a liquid-crystal section situated over faceplate support structure 66. The inert gas is formed with one or more of xenon, neon, helium, krypton, and argon. The getter in compartment 50 does not collect atoms or ions of the inert gas, and thus is not significantly affected by the presence of the inert gas.

One of support structures of 64 and 66 can be deleted from the flat-panel plasma display, again provided that the thickness (and strength) of plate structure 40 or 42 not covered by exterior support structure is great enough to prevent the display from collapsing due to external forces applied to compartment 50 when its internal pressure is significantly less than the immediate external pressure. Either FIG. 2*f*1 or 2*f*2 then replaces FIG. 2*f*. The final plasma display then appears as shown in FIG. 2*h*1 or 2*h*2 subject to compartment 50 containing inert gas at the desired pressure rather than being at a high vacuum. The manufacturing processes of FIG. 6–12 are modified in a similar manner to that of FIG. 2 to produce a flat-panel plasma display or a flat-panel plasma-addressed LCD.

Directional terms such as "top", "bottom", "upper", "lower", and the like have been employed in describing the present invention to establish a frame of reference by which the reader can understand how the various parts of a flat-panel device fit together. In actual practice, the components of a flat-panel device may be situated at orientations different from those implied by the directional terms used here. Inasmuch as directional terms are used for convenience to facilitate the description, the invention encompasses implementations in which the orientation is different from those strictly covered by the directional terms employed here.

While the invention has been described with reference to particular embodiments, this description is solely for the purpose of illustration and is not to be construed as limiting the scope of the invention claimed below. For example, the nitrogen back filled into display compartment 50 after the pre-attachment bake can be replaced with another gas, normally an inert gas such as argon, that does not significantly react with any of the display components that form compartment 50. The pre-attachment bake can be deleted in some cases. The post-attachment bake can likewise sometimes be deleted.

Instead of having pump-out port 46/48/52 open to the inside of vacuum chamber 56 at the stage of FIG. 2*c* in the process of FIG. 2, port 46/48/52 can be connected to a tube that connects to nitrogen source 60 and to a vacuum pump separate from vacuum pump 58P. Display compartment 50 is pumped to the low pre-attachment pressure with the separate vacuum pump while chamber 56 is simultaneously pumped to the same pressure with vacuum pumping system 58. After performing the pre-attachment bake, the separate vacuum pump is de-activated, and dry nitrogen is introduced directly from nitrogen source 60 through port 46/48/52 into compartment 50 to bring it up to approximately room pressure. Pumping system 58 is controlled in a manner that enables the pressure in chamber 56 to rise simultaneously to room pressure. No significant pressure differential exists across any of components 40–46 and 52 during the pre-attachment pump down or the nitrogen back fill.

The flat-panel display can be provided with multiple pump-out ports. Rather than one getter-containing auxiliary compartment 162 or 186 or one support member 190 having cavities for multiple getter-containing auxiliary compartments 202, the flat-panel display can be provided with multiple separate auxiliary walls for multiple getter-containing compartments. The separate auxiliary walls can be attached to the display before the pre-attachment bake or after the pre-attachment bake so as to constitute exterior support structure.

In addition to reduced-pressure flat-panel displays, the fabrication process of the invention can be employed in fabricating other types of flat-panel displays such as liquid-crystal displays, light-emitting diode displays, and electroluminescent displays. The present manufacturing process can also be applied to flat-panel devices, especially reduced-pressure (e.g., high vacuum) flat-panel devices, other than displays. Various modifications and applications may thus be made by those skilled in the art without departing from the true scope and spirit of the invention as described in the appended claims.

We claim:

1. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall such that there is port means through which gas can enter and leave the compartment;

subsequently removing gas from the compartment through the port means to pump the compartment down to a compartment pressure no greater than 0.1 atm.;

subsequently introducing selected gas into the compartment through the port means to raise the compartment pressure; and subsequently attaching a first support structure to the first plate structure along a second surface thereof opposite the first plate structure's first surface so as to significantly increase resistance of the compartment to bending.

2. A method as in claim 1 wherein the first support structure is bonded to the first plate structure largely wherever they substantially adjoin.

3. A method as in claim 1 wherein:

there is a minimum value of resistance to bending that material along each first surface outside the compartment needs to have in order to prevent the compartment from collapsing due to external forces applied to the compartment;

the first plate structure and the first support structure, in combination, have a resistance to bending greater than or equal to the minimum value; and the second plate structure has a resistance to bending greater than or equal to the minimum value.

4. A method as in claim 1 further including, subsequent to the attaching step, the steps of:

removing gas from the compartment through the port means to pump the compartment down to a compartment pressure no greater than 0.1 atm.; and subsequently closing the port means.

5. A method as in claim 4 wherein the compartment pressure is pumped down to a value no greater than $10^{-2}$ torr during the gas-removing step performed subsequent to the attaching step.

6. A method as in claim 4 further including, subsequent to the attaching step, the steps of:

heating the compartment to a temperature high enough to cause outgassing from at least one of the plate structures and outer wall to occur into the compartment; and subsequently cooling the compartment.

7. A method as in claim 6 wherein the gas-removing step performed subsequent to the attaching step is initiated before the heating step and is performed during at least part of the heating and cooling steps.

8. A method as in claim 1 wherein the first support structure comprises at least one support plate.

9. A method as in claim 1 wherein the first support structure comprises multiple bars or multiple rings.

10. A method as in claim 1 wherein the first support structure comprises a support plate and multiple bars overlying or underlying the support plate.

11. A method as in claim 1 wherein the first support structure comprises a honeycomb structure.

12. A method as in claim 1 wherein the first support structure comprises a printed circuit board that contains circuitry for controlling the flat-panel device.

13. A method as in claim 1 wherein the first support structure comprises at least one of largely solid material and porous material.

14. A method as in claim 1 wherein the first support structure consists primarily of at least one of glass, plastic, polymeric material, ceramic, and metal.

15. A method as in claim 1 wherein the port means does not extend significantly further away from the first plate structure than the first support structure after the port means is permanently closed.

16. A method as in claim 1 wherein the first support structure overlies at least 50% of the first plate structure by projected area.

17. A method as in claim 1 wherein the flat-panel device is a flat-panel display that provides a desired image.

18. A method as in claim 17 wherein:

one of the plate structures contains multiple electron-emissive elements; and the other plate structure contains multiple light-emissive elements that emit light upon being struck by electrons emitted from the electron-emissive elements.

19. A method as in claim 17 wherein the desired image is provided on a surface of the first support structure.

20. A method as in claim 1 wherein pressure outside the compartment approximately matches the compartment pressure during the gas-removing step and during the gas-introducing step.

21. A method as in claim 1 wherein the compartment pressure is pumped down to a value no greater than $10^{-2}$ torr during the gas-removing step.

22. A method as in claim 1 wherein the selected gas consists primarily of at least one of nitrogen and inert gas.

23. A method as in claim 22 wherein the compartment pressure is raised to approximately room pressure during the gas-introducing step.

24. A method as in claim 1 further including, between the gas-introducing and attaching steps, the step of temporarily closing the port means so that the compartment is closed during the attaching step.

25. A method as in claim 24 wherein the port means is open during the attaching step, the attaching step being performed in such a manner that largely no gas detrimental to elements along the first surfaces enters the compartment during the attaching step.

26. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall such that there is port means through which gas can enter and leave the compartment;

subsequently heating the compartment to a temperature high enough to cause outgassing from at least one of the plate structures and outer wall to occur into the compartment;

subsequently cooling the compartment; and subsequently attaching a first support structure to the first plate structure along a second surface thereof opposite the first plate structure's first surface so as to significantly increase resistance of the compartment to bending.

27. A method as in claim 26 wherein the first support structure is bonded to the first plate structure largely wherever they substantially adjoin.

28. A method as in claim 26 wherein:

there is a minimum value of resistance to bending that material along each first surface outside the compartment needs to have in order to prevent the compartment from collapsing due to external forces applied to the compartment;

the first plate structure and the first support structure, in combination, have a resistance to bending greater than or equal to the minimum value; and the second plate structure has a resistance to bending greater than or equal to the minimum value.

29. A method as in claim 26 further including, subsequent to the attaching step, the steps of:

removing gas from the compartment through the port means to pump the compartment down to a compartment pressure no greater than 0.1 atm.; and subsequently closing the port means.

30. A method as in claim 29 wherein the compartment pressure is pumped down to a value no greater than $10^{-2}$ torr during the gas-removing step.

31. A method as in claim 26 wherein the first support structure comprises at least one support plate.

32. A method as in claim 26 wherein the first support structure comprises multiple bars or multiple rings.

33. A method as in claim 26 wherein the first support structure comprises a support plate and multiple bars overlying or underlying the support plate.

34. A method as in claim 26 wherein the first support structure comprises a honeycomb structure.

35. A method as in claim 26 wherein the first support structure comprises a printed circuit board that contains circuitry for controlling the flat-panel device.

36. A method as in claim 26 wherein the first support structure comprises at least one of largely solid material and porous material.

37. A method as in claim 26 wherein the first support structure consists primarily of at least one of glass, plastic, polymeric material, ceramic, and metal.

38. A method as in claim 26 wherein the port means does not extend significantly further away from the first plate structure than the first support structure after the port means is permanently closed.

39. A method as in claim 26 wherein the first support structure overlies at least 50% of the first plate structure by projected area.

40. A method as in claim 26 wherein the flat-panel device is a flat-panel display that provides a desired image.

41. A method as in claim 40 wherein:

one of the plate structures contains multiple electron-emissive elements; and the other plate structure contains multiple light-emissive elements that emit light upon being struck by electrons emitted from the electron-emissive elements.

42. A method as in claim 40 wherein the desired image is provided on a surface of the first support structure.

43. A method as in claim 26 further including, between the hermetic sealing and attaching steps, the step of removing gas from the compartment through the port means to pump the compartment down to a compartment pressure no greater than 0.1 atm.

44. A method as in claim 43 wherein pressure outside the compartment approximately matches the compartment pressure during the gas-removing step.

45. A method as in claim 43 wherein the gas-removing step is initiated prior to the heating step and is performed during at least part of the heating and cooling steps.

46. A method as in claim 43 further including, between the gas-removing and attaching steps, the step of introducing selected gas into the compartment through the port means.

47. A method as in claim 46 wherein pressure outside the compartment approximately matches the compartment pressure during the gas-introducing step.

48. A method as in claim 47 further including, subsequent to the attaching step, the steps of:

heating the compartment to a temperature high enough to cause outgassing from at least one of the plate structures and outer wall to occur into the compartment but sufficiently low that no significant degradation occurs to the first support structure or to any material that attaches the first support structure to the first plate structure; and subsequently cooling the compartment.

49. A method as in claim 48 wherein the compartment reaches a lower maximum temperature during the heating step subsequent to the attaching step than during the heating step prior to the attaching step.

50. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall; and subsequently attaching a first support structure to the first plate structure along a second surface thereof opposite the first plate structure's first surface so as to significantly increase resistance of the compartment to bending, the first support structure being provided with at least one cavity internal to the flat-panel device, a getter being provided in at least one such cavity.

51. A flat-panel device comprising:

a first plate structure, a second plate structure, and a generally annular outer wall that extends between the plate structures to form a main compartment with the plate structures;

a support member that contacts the first plate structure outside the main compartment and contains a plurality of cavities that form corresponding auxiliary compartments with the first plate structure, each auxiliary compartment connected pressure-wise to the main compartment or to at least one other auxiliary compartment such that the main and auxiliary compartments reach largely equal steady-state compartment pressures; and a plurality of getters, each situated in a different one of the auxiliary compartments.

52. A device as in claim 51 wherein:

the first plate structure contains multiple electron-emissive elements; and the second plate structure contains multiple light-emissive elements that emit light upon being struck by electrons emitted from the electron-emissive elements.

53. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall, the compartment being pressure-wise connected to an auxiliary compartment which at least partially overlies the first plate structure; and subsequently attaching a first support structure to the first plate structure along a second surface thereof opposite the first plate structure's first surface so as to significantly increase resistance of the compartment to bending.

54. A method as in claim 53 wherein a getter is inserted into the auxiliary compartment.

55. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall; and subsequently attaching a first support structure to the first plate: structure along a second surface thereof opposite the first plate structure's first surface so as to significantly increase resistance of the compartment to bending, the attaching step entailing bringing liquid material of the first support structure into contact with the first plate structure and then allowing or causing the liquid material to harden so that the first support structure is directly attached to the first plate structure.

56. A method as in claim 55 wherein the attaching step entails depositing the first support structure in liquid form on the first plate structure and then allowing or causing the liquid form of the first support structure to harden.

57. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall;

subsequently attaching a first support structure to the first plate structure along a second surface thereof opposite the first plate structure's first surface so as to significantly increase resistance of the compartment to bending such that there is port means through which gas can enter and leave the compartment;

subsequently removing gas from the compartment through the port means to pump the compartment down to a compartment pressure no greater than 0.1 atm.;

subsequently introducing selected gas into the compartment through the port means; and subsequently closing the port means.

58. A method as in claim 57 wherein the selected gas consists primarily of inert gas capable of being ionized.

59. A method as in claim 57 wherein:

there is a minimum value of resistance to bending that material along each first surface outside the compartment needs to have in order to prevent the compartment from collapsing due to external forces applied to the compartment;

the first plate structure and the first support structure, in combination, have a resistance to bending greater than or equal to the minimum value; and the second plate structure has a resistance to bending greater than or equal to the minimum value.

60. A method as in claim 57 wherein the port means does not extend significantly further away from the first plate structure than the first support structure after the port means is permanently closed.

61. A method as in claim 57 further including, subsequent to the sealing step, the step of attaching a second support structure to the second plate structure along a second surface thereof opposite the second plate structure's first surface so as to further significantly increase the resistance of the compartment to bending.

62. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall; and subsequently attaching a first support structure to the first plate structure along a second surface thereof opposite the first plate structure's first surface so as to significantly increase resistance of the compartment to bending, the first support structure comprising a printed circuit board that contains circuitry for controlling the flat-panel device.

63. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall such that there is port means through which gas can enter and leave the compartment;

removing gas from the compartment through the port means to pump the compartment down to a compartment pressure no greater than 0.1 atm.;

introducing selected gas into the compartment through the port means; and subsequently (a) attaching a first support structure to the first plate structure along a second surface thereof opposite the first plate structure's first surface so as to significantly increase resistance of the compartment to bending and (b) attaching a second support structure to the second plate structure along a second surface thereof opposite the second plate structure's first surface so as to further significantly increase the resistance of the compartment to bending.

64. A method as in claim 63 further including, after the hermetic sealing step and before the attaching steps, the steps of:

heating the compartment to a temperature high enough to cause outgassing from at least one of the plate structures and the outer wall to occur into the compartment; and subsequently cooling the compartment.

65. A method comprising the following steps for manufacturing a flat-panel device:

hermetically sealing (a) a first plate structure along a first surface thereof to an outer wall along a first edge thereof and (b) a second plate structure along a first surface thereof to the outer wall along a second edge thereof opposite the first edge to form a device compartment from the plate structures and outer wall such that there is port means through which gas can enter and leave the compartment;

heating the compartment to a temperature high enough to cause outgassing from at least one of the plate structures and the outer wall to occur into the compartment;

subsequently cooling the compartment; and subsequently (a) attaching a first support structure to the first plate structure along a second surface thereof opposite the first plate structure's first surface so as to significantly increase resistance of the compartment to bending and (b) attaching a second support structure to the second plate structure along a second surface thereof opposite the second plate structure's first surface so as to further significantly increase the resistance of the compartment to bending.

66. A method as in claim 53 further including, subsequent to the sealing step, the step of attaching a second support structure to the second plate structure along a second surface thereof opposite the second plate structure's first surface so as to further significantly increase the resistance of the compartment to bending.

67. A method as in claim 50 further including, subsequent to the sealing step, the step of attaching a second support structure to the second plate structure along a second surface thereof opposite the second plate structure's first surface so as to further significantly increase the resistance of the compartment to bending.

68. A method as in claim 55 further including, subsequent to the sealing step, the step of attaching a second support structure to the second plate structure along a second surface thereof opposite the second plate structure's first surface so as to further significantly increase the resistance of the compartment to bending.

69. A method as in claim 62 further including, subsequent to the sealing step, the step of attaching a second support structure to the second plate structure along a second surface thereof opposite the second plate structure's first surface surface so as to further significantly increase the resistance of athe compartment to bending.

* * * * *